US011181090B2

(12) United States Patent
Kinoshita et al.

(10) Patent No.: US 11,181,090 B2
(45) Date of Patent: Nov. 23, 2021

(54) IGNITION APPARATUS

(71) Applicants: DENSO CORPORATION, Kariya (JP); PLASMA APPLICATIONS CO., LTD., Hamamatsu (JP)

(72) Inventors: Shota Kinoshita, Kariya (JP); Fumiaki Aoki, Nisshin (JP); Daisuke Tanaka, Nisshin (JP); Akimitsu Sugiura, Kariya (JP); Jan Husarik, Hamamatsu (JP); Masashi Kando, Hamamatsu (JP)

(73) Assignees: DENSO CORPORATION, Kariya (JP); PLASMA APPLICATIONS CO., LTD., Hamamatsu (JP)

( * ) Notice: Subject to any disclaimer, the term of this patent is extended or adjusted under 35 U.S.C. 154(b) by 0 days.

(21) Appl. No.: 16/007,174

(22) Filed: Jun. 13, 2018

(65) Prior Publication Data

US 2018/0363618 A1 Dec. 20, 2018

(30) Foreign Application Priority Data

Jun. 14, 2017 (JP) ..... JP2017-117132

(51) Int. Cl.
*F02P 9/00* (2006.01)
*F02P 3/01* (2006.01)
(Continued)

(52) U.S. Cl.
CPC ..... *F02P 9/007* (2013.01); *F02P 3/01* (2013.01); *H01T 13/50* (2013.01); *H01T 15/00* (2013.01); *F02P 9/002* (2013.01); *F02P 23/04* (2013.01)

(58) Field of Classification Search
CPC ..... F02P 9/007; F02P 9/002; H01T 13/50; H05H 1/2406; H05H 2001/2412
See application file for complete search history.

(56) References Cited

U.S. PATENT DOCUMENTS 5,469,013 A * 11/1995 Kang ..... H01T 13/50 313/128
7,644,698 B2 * 1/2010 Shiraishi ..... F01L 13/0026 123/146.5 R
(Continued)

FOREIGN PATENT DOCUMENTS

EP 2273632 A2 * 1/2011 ..... H01T 13/44
JP 2000-345951 12/2000
(Continued)

OTHER PUBLICATIONS

English machine translation of JP-2010272323-A provided by ip.com (Year: 2019).*
(Continued)

*Primary Examiner* — Michael A Kessler
(74) *Attorney, Agent, or Firm* — Nixon & Vanderhye P.C.

(57) ABSTRACT

In an ignition apparatus, an ignition plug is provided. In the ignition plug, a tubular outer conductor surrounds an inner conductor, and a dielectric member is disposed in the tubular outer conductor to define a plasma formation region between the inner conductor and the dielectric member. The plasma formation region has opposing first and second ends in the axial direction of the tubular outer conductor, and the first end of the plasma formation region communicates with the combustion chamber. A power source is connected between the inner and tubular outer conductors. A controller causes a power source to apply electromagnetic power pulses with intervals therebetween across the inner and tubular outer conductors during an ignition cycle of an engine. Each of the electromagnetic power pulses forms at least a corresponding plasma in the plasma formation region.

13 Claims, 13 Drawing Sheets

(51) Int. Cl.

| | |
|---|---|
| ***H01T 15/00*** | (2006.01) |
| ***H01T 13/50*** | (2006.01) |
| *F02P 23/04* | (2006.01) |

(56) References Cited

U.S. PATENT DOCUMENTS

| | | | | |
|---|---|---|---|---|
| 10,132,286 | B2 * | 11/2018 | Ikeda | F02P 15/08 |
| 2009/0031988 | A1 * | 2/2009 | Shiraishi | F02P 23/04 123/406.19 |
| 2009/0126668 | A1 * | 5/2009 | Shiraishi | H01T 13/50 123/145 A |
| 2009/0126684 | A1 * | 5/2009 | Shiraishi | F02D 41/3041 123/406.12 |
| 2010/0192909 | A1 | 8/2010 | Ikeda | |
| 2013/0049566 | A1 * | 2/2013 | Burrows | H01T 21/02 313/141 |
| 2015/0167625 | A1 | 6/2015 | Ikeda | |
| 2016/0084215 | A1 * | 3/2016 | Kondou | F02P 3/0435 123/620 |
| 2016/0102648 | A1 * | 4/2016 | Nakayama | F02P 3/0435 123/604 |
| 2018/0291861 | A1 * | 10/2018 | Hagari | F02P 9/002 |
| 2020/0084872 | A1 * | 3/2020 | Tanaka | F02P 3/01 |

FOREIGN PATENT DOCUMENTS

| | | | | |
|---|---|---|---|---|
| JP | 2010037949 | A * | 2/2010 | |
| JP | 2010272323 | A * | 12/2010 | H01T 13/52 |
| JP | 2011150830 | A * | 8/2011 | F02P 23/04 |
| JP | 2016-149342 | | 8/2016 | |
| WO | WO-9310348 | A1 * | 5/1993 | F02P 9/007 |

OTHER PUBLICATIONS

English machine translation provided by ESPACENET of EP-2273632-A2 (Year: 2020).*

* cited by examiner

FIG.11
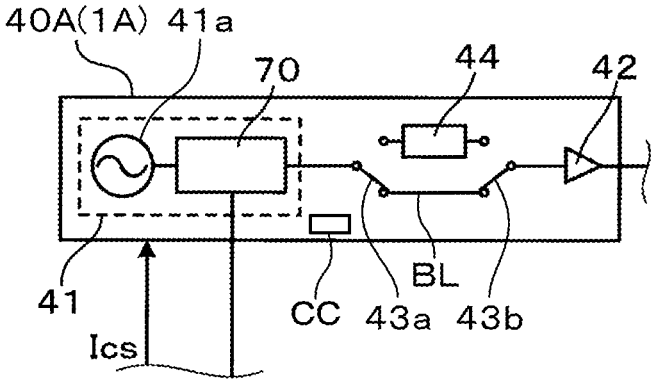
FIG.12A
FIG.12B
FIG.12C
FIG.12D
FIG.12E
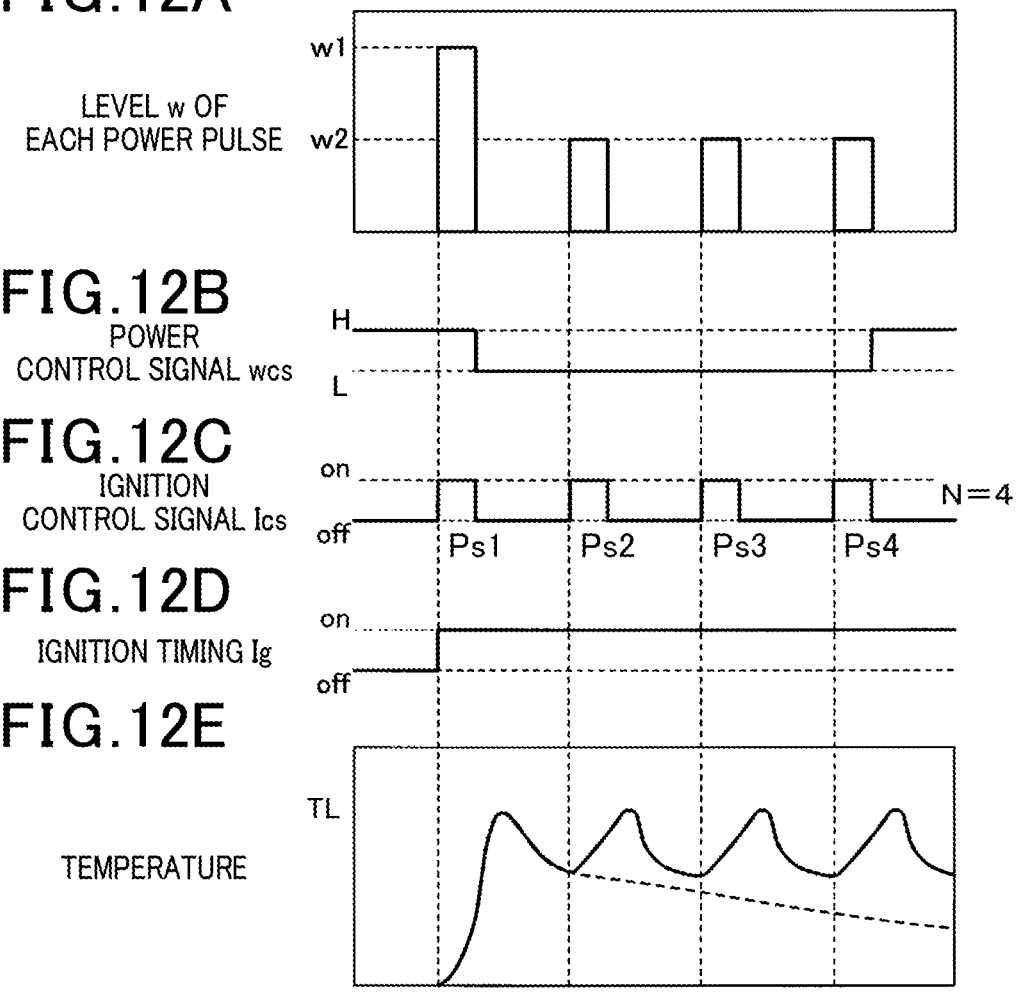

LEVEL w OF EACH POWER PULSE

SERIAL COMMUNICATION SIGNAL Sc

IGNITION CONTROL SIGNAL Ics

IGNITION TIMING Ig

IGNITION APPARATUS

CROSS REFERENCE TO RELATED APPLICATION

This application is based on and claims the benefit of priority from Japanese Patent Application No. 2017-117132 filed on Jun. 14, 2017, the disclosure of which is incorporated in its entirety herein by reference.

TECHNICAL FIELD

The present disclosure relates to ignition apparatuses.

BACKGROUND

Some ignition apparatuses for internal combustion engines are configured to ignite the mixture of fuel and air using electromagnetic waves and plasma.

WO 2014/034715, which will be referred to as a published patent document, discloses an example of such ignition apparatuses. The ignition apparatus disclosed in the published patent document is configured to apply high-voltage pulses output from an ignition coil across a center electrode and a ground electrode that have a discharge gap therebetween. This causes a spark to be generated across the center electrode and ground electrode, the discharged spark forming a spark-based plasma. The ignition apparatus disclosed in the published patent document is also configured to irradiate electromagnetic waves from an electromagnetic-wave antenna to the formed spark-based plasma, thus increasing and/or maintaining the volume of the spark-based plasma.

The ignition apparatus disclosed in the published patent document is specially configured to intermittently irradiate the electromagnetic waves to the formed spark-based plasma, making it possible to reduce electrical power consumed by the irradiation of the electromagnetic waves.

SUMMARY

The ignition apparatus disclosed in the published patent document unfortunately requires both the assembly of the center and ground electrodes for generating a spark-based plasma and the electromagnetic-wave antenna for increasing and/or maintaining the volume of the formed spark-based plasma. This may result in the ignition apparatus disclosed in the published patent document having a more complicated structure, a larger size, a higher cost, and/or an increase in the number of parts thereof.

Additionally, the ignition apparatus disclosed in the published patent document may result in the spark-based plasma or an initial flame generated based on the spark-based plasma being likely to stay at a location close to the discharge gap, resulting in the spark-based plasma or the initial flame being likely to be cooled by the assembly of the center and ground electrodes. This may prevent the growth of the flame and thereby reduce the ignitability of the air-fuel mixture based on the flame.

In view of the above circumstances, one aspect of the present disclosure seeks to provide ignition apparatuses, each of which has at least one of a simpler structure, a smaller size, a lower manufacturing cost, and a more improved ignitability of an air-fuel mixture.

According to an exemplary aspect of the present disclosure, there is provided an ignition apparatus for igniting, based on a plasma, an air-fuel mixture in a combustion chamber of an internal combustion engine. The ignition apparatus includes an ignition plug. The ignition plug includes an inner conductor, a tubular outer conductor having an axial direction and arranged to surround the inner conductor, and a dielectric member disposed in the tubular outer conductor to define a plasma formation region between the inner conductor and the dielectric member. The plasma formation region has opposing first and second ends in the axial direction of the tubular outer conductor. The first end of the plasma formation region communicates with the combustion chamber. The ignition apparatus includes a power source connected between the inner conductor and the tubular outer conductor and configured to generate at least one electromagnetic power pulse, and a controller configured to cause the power source to apply electromagnetic power pulses with intervals therebetween across the inner conductor and the tubular outer conductor during an ignition cycle of the internal combustion engine. Each of the electromagnetic power pulses forms at least a corresponding plasma in the plasma formation region.

The ignition apparatus is configured to generate a plasma in the plasma formation region defined between the inner conductor and the dielectric member. This enables the plasma to ignite the air-fuel mixture, resulting in an initial flame to be generated.

As compared with the configuration of the conventional ignition apparatus disclosed in the published patent document, which requires both the assembly of the center and ground electrodes for generating a spark-based plasma and the electromagnetic-wave antenna for increasing and/or maintaining the volume of the formed spark-based plasma, the configuration of the ignition apparatus results in at least one of (1) A smaller number of components thereof
(2) A simpler structure
(3) A smaller size
(4) A lower manufacturing cost Additionally, the ignition apparatus is configured to apply power pulses with intervals therebetween to the ignition plug during an ignition cycle of the internal combustion engine. Applying each power pulse to the ignition plug yields in 1. An increase in the temperature in the plasma formation region based on formation of a plasma
2. An increase in the volume of a plasma aggregation in the plasma formation region based on the formation and development of the plasma and the combustion of the air-fuel mixture in the plasma formation region This increases the internal pressure of the plasma formation region.

That is, applying each power pulse to the ignition plug enables a new plasma and a new initial flame based on the new plasma to be formed in the plasma formation region, resulting in the new plasma and the new initial flame being emitted from the plasma formation region into the combustion chamber based on the increase of the internal pressure of the plasma formation region.

This therefore makes it possible to cause a new plasma aggregate based on the new plasma and the new initial flame to collide with a previous plasma aggregate remaining in the combustion chamber, thus combining the new plasma aggregate with the previous plasma aggregate. This causes the plasma aggregate to further grow, thus enlarging the flame kernel while producing a larger plasma aggregate deep inside the combustion chamber. This makes it possible for the plasma aggregate located deep inside the combustion chamber to fire a part of the air-fuel mixture located away from the ignition plug and an inner wall of the combustion chamber. This therefore prevents the plasma aggregate from being cooled by the ignition plug and/or by the inner wall of the combustion chamber to thereby enable smooth development of the plasma aggregate, resulting in an improvement of the ignitability of the air-fuel mixture in the combustion chamber.

To sum up, the exemplary aspect of the present disclosure makes it possible to provide an ignition apparatus that has at least one of a simpler structure, a smaller size, a lower manufacturing cost, and a more improved ignitability of the air-fuel mixture.

BRIEF DESCRIPTION OF THE DRAWINGS

Other aspects of the present disclosure will become apparent from the following description of embodiments with reference to the accompanying drawings in which:

FIG. 11 is a circuit diagram schematically illustrating an example of a power source according to the second embodiment;

FIGS. 12A to 12E are a joint timing chart schematically illustrating a relationship between a level of each power pulse, an ignition control signal, a power control signal, an ignition timing, and a temperature in the plasma formation region according to the second embodiment;

DETAILED DESCRIPTION OF EMBODIMENT

Figure 1:
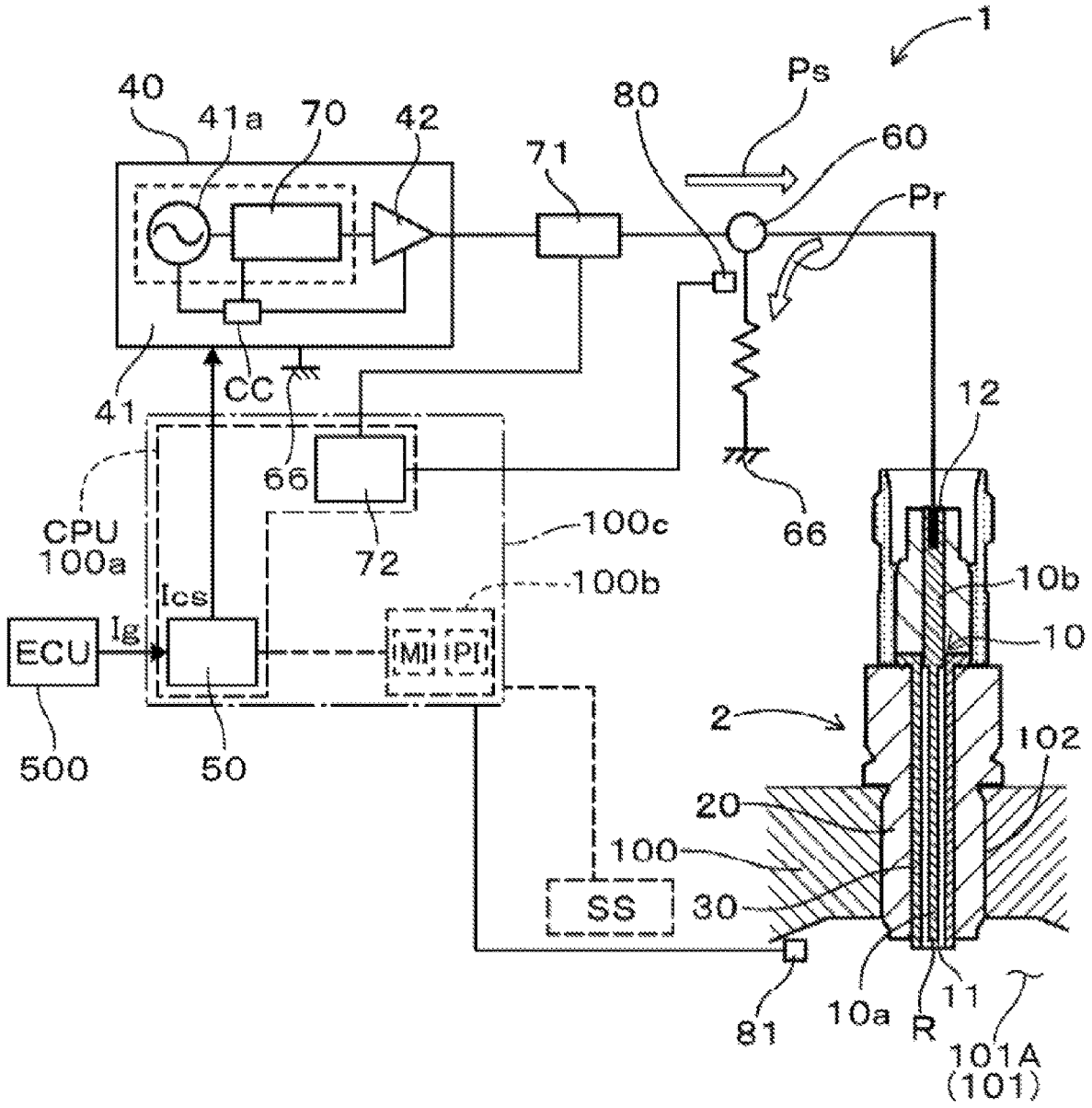
FIG. 1 is a circuit diagram schematically illustrating an example of the overall structure of an ignition apparatus according to the first embodiment of the present disclosure.

The following describes exemplary embodiments of the present disclosure with reference to the accompanying drawings. In the embodiments, like parts between the embodiments, to which like reference characters are assigned, are omitted or simplified to avoid redundant description.

First Embodiment

The following describes the first embodiment of the present disclosure with reference to FIGS. 1 to 9.

Referring to FIG. 1, an ignition apparatus 1 according to the first embodiment is configured to ignite the mixture of fuel and air in the combustion chamber 101A in at least one cylinder 101 of an internal combustion engine EN of a vehicle using a plasma, thus generating an initial flame in the combustion chamber 101A.

The ignition apparatus 1 includes an ignition plug 2, an electromagnetic power source, referred to simply as a power source, 40, an output controller 50, an isolator 60, an impedance adjuster 71, a matching controller 72, a reflected-power detector 80, and a flow rate detector 81.

The ignition plug 2, which has a predetermined length in its longitudinal direction, is comprised of, for example, a circular tubular inner conductor 10, a circular tubular outer conductor 20, and a circular tubular dielectric member 30.

The inner conductor 10 is comprised of a first inner conductor member 10*a* having a first end 11 and a second end opposite to each other in its axial directions, i.e. its longitudinal directions, and a second inner conductor member 10*b* having a first end and a second end 12 opposite to each other in its axial directions. Each of the first and second inner tubular members 10*a* and 10*b* has a predetermined diameter, and the diameter of the second inner tubular member 10*b* is larger than the diameter of the first inner tubular member 10*a*. The first end of the second inner conductor member 10*b* is joined to the second end of the first inner conductor member 10*a* such that the second conductor member 10*b* coaxially extends from the first inner conductor member 10*a*.

The tubular outer conductor 20 has an inner diameter larger than the diameter of the first tubular member 10*a*. The tubular outer conductor 20 is disposed to be coaxial with the first inner tubular member 10*a* to surround the outer periphery 11*b* of the first inner tubular member 10*a*. In other words, the first inner tubular member 10*a* is coaxially installed in the tubular outer conductor 20.

The dielectric member 30 is coaxially disposed in the tubular outer conductor 20 such that its outer periphery 31*c* contacts the inner periphery 22*a* of the tubular outer conductor 20, resulting in an annular space R defined between the outer periphery 11*b* of the inner tubular conductor 10 and the inner periphery 31*b* of the dielectric member 30. The space defined between the inner tubular conductor 10 and the dielectric member 30 serves as a plasma formation region R in which a plasma is to be formed.

The dielectric member 30 has opposing a first end 31 and a second end in its axial directions, and the first end 31 of the dielectric member 30 is designed as an opening end that communicates with the plasma formation region R.

As illustrated in FIG. 1, the internal combustion engine EN, which will be simply referred to as an engine EN, is comprised of a cylinder block in which the at least one cylinder 101 is formed. The engine EN is also comprised of a cylinder head 100 fastened to the top of the cylinder block to cover the at least one cylinder 101. The cylinder head 100 has at least one through hole 102 formed therethrough and communicating with the combustion chamber 101A of the at least one cylinder 101. The ignition plug 2 is fitted in the through hole 102 such that the outer periphery 21*a* of the tubular outer conductor 20 contacts the inner periphery of the through hole 102 and the plasma formation region R communicates with the combustion chamber 101 via the opening first end 31 of the dielectric member 30.

Figure 2:
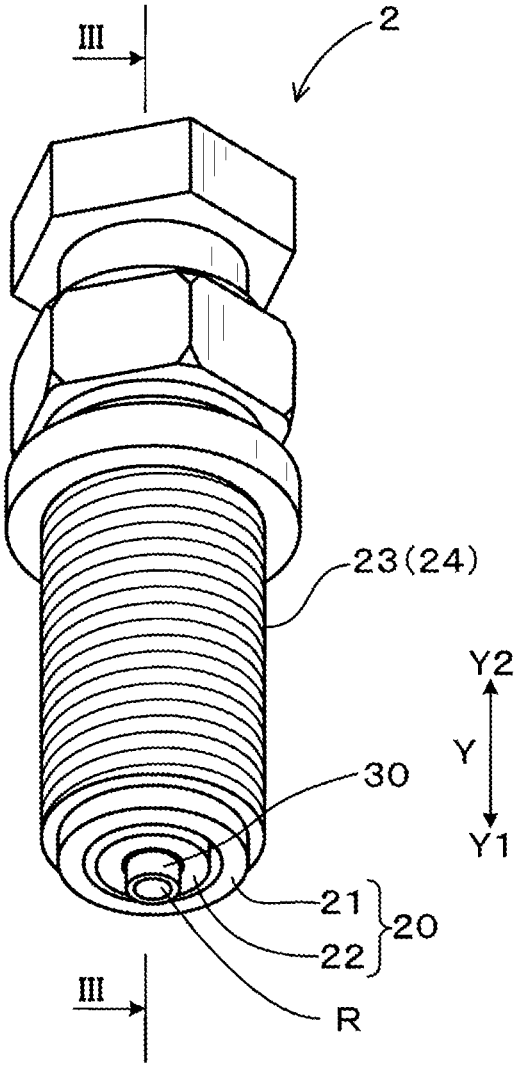
FIG. 2 is an enlarged perspective view schematically illustrating an ignition plug illustrated in FIG. 1.
Figure 3:
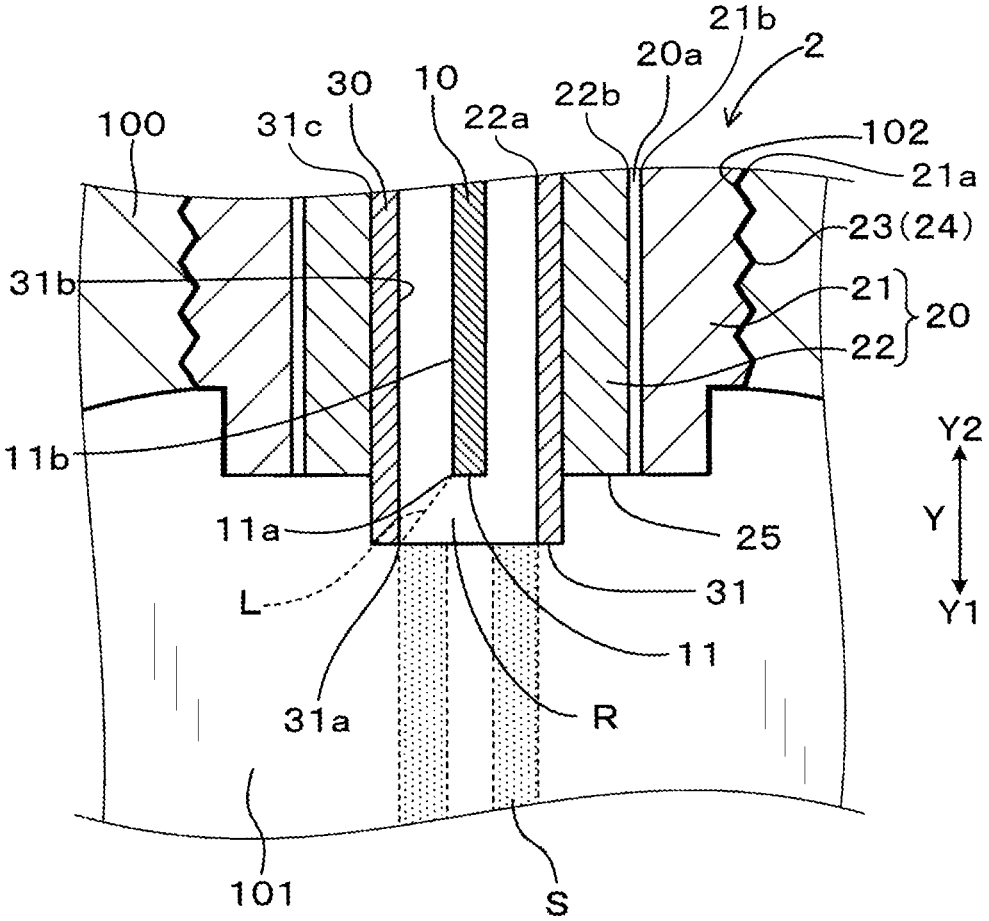
FIG. 3 is an enlarged axial cross-sectional view taken along line III-III in FIG. 2.

Referring to FIGS. 2 and 3, the tubular outer conductor 20 is comprised of a cylindrical tubular first outer conductor member 21 and a second outer conductor member 22 disposed in the first outer conductor member 21 to be coaxial with the first outer conductor member 21. As illustrated in FIG. 3, the tubular outer conductor 20 includes a cylindrical tubular clearance 20*a* defined between the outer periphery 22*b* of the second outer conductor member 22 and the inner periphery 21*b* of the first outer conductor member 21. That is, the inner periphery 22*a* of the second outer conductor member 21 constitutes the inner periphery 22*a* of the tubular outer conductor 20, and the outer periphery 21*a* of the first outer conductor member 21 constitutes the outer periphery 21*a* of the tubular outer conductor 20.

The first outer conductor member 21 serves as a housing of the ignition plug 2, and the first outer conductor member 21 includes a threaded portion 24 formed on the outer periphery 21*a* thereof. The inner periphery of the through hole 102 also includes a threaded portion formed thereon. Mounting the ignition plug 2 into the through hole 101 such that the threaded portion 24 of the outer periphery 21*a* of the first outer conductor member 21 is engaged with the threaded portion of the inner periphery of the through hole 102 enables the ignition plug 2 to be fastened to the cylinder head 100.

Note that the first and second conductor members 21 and 22 can be integrated with each other without defining the tubular clearance 20*a* between the first and second conductor members 21 and 22.

The tubular outer conductor 20 is grounded.

In each of FIGS. 2 and 3, the axial directions of each of the cylindrical tubular members 10, 20, and 30 are referred to as plug axial directions Y. The plug axial directions Y have a first direction Y1 leading from the second end of the first inner tubular member 10*a* to the first end 11 of the first inner tubular member 10*a*, and a second direction Y2 opposite to the first direction Y1.

Referring to FIG. 3, the second outer conductor member 22 has a first end 25 and a second end opposite to the first end 25 in its axial direction. The first end 31 of the dielectric member 30 is located to be farther from the cylinder head 100 than the first end 25 of the second outer conductor member 22 is in the Y1 direction. In other words, the first end 31 of the dielectric member 30 is located to be closer to an unillustrated piston in the at least one cylinder 101 than the first end 25 of the second outer conductor member 22 is in the Y1 direction.

Similarly, the first end 31 of the dielectric member 30 is located to be farther from the cylinder head 100 than the first end 11 of the first inner conductor member 10*a* is in the Y1 direction. In other words, the first end 31 of the dielectric member 30 is located to be closer to the unillustrated piston of the at least one cylinder 101 than the first end 11 of the first inner conductor member 10*a* is in the Y1 direction.

In other words, the first end 31 of the dielectric member 30 projects toward the combustion chamber 101A relative to the first end 25 of the second outer conductor member 22 and the first end 11 of the first inner conductor member 10*a* in the Y1 direction.

The dielectric member 30 can be composed of a material that enables the strength of an electric field generated at the first end 11 of the first inner conductor member 10*a* upon electrical power being applied across the inner conductor 10 and the outer conductor 20 to be increased. An increase in the strength of the electric field generated at the first end 11 of the first inner conductor member 10*a* upon electrical power being applied across the inner conductor 10 and the outer conductor 20 enables electrical discharge between the dielectric member 30 and the first end 11 of the first inner conductor member 10*a* to be easily generated. For example, a relatively high dielectric material, such as alumina, can be used as the material of the dielectric member 30.

As described above, the outer periphery 11*b* of the first inner tubular member 10*a* and the inner periphery 31*b* of the dielectric member 31 are separated from each other, resulting in the plasma formation space R being located therebetween.

The first end 11 of the first inner conductor member 10*a* is located to be closer to the cylinder head 100 than the first end 31 of the dielectric member 30 is in the Y2 direction. The position of the first end 25 of the second outer conductor member 22 and the position of the first end 11 of the first inner conductor member 10*a* in the plug axial directions Y are substantially the same as each other.

The inner conductor 10 can be composed of a material that enables the strength of an electric field generated at the first end 11 of the first inner conductor member 10*a* upon electrical power being applied across the inner conductor 10 and the outer conductor 20. An increase in the strength of the electric field generated at the first end 11 of the first inner conductor member 10*a* upon electrical power being applied across the inner conductor 10 and the outer conductor 20 enables electrical discharge between the dielectric member 30 and the first end 11 of the first inner conductor member 10*a* to be easily generated. For example, a relatively high dielectric material, such as alumina, can be used as the material of the dielectric member 30.

The inner conductor 10 can be composed of a material having a relatively low electric-conductivity, or an alloy containing a relatively low electric-conductive material. This enables the first end 11 of the first inner conductor member 10*a* to be easily heated upon electrical power being applied across the inner conductor 10 and the outer conductor 20. Any material whose electric conductivity is lower than the electric conductivity of a copper material can be used as a material or an alloy of the inner conductor 10. Note that a material or an alloy having a relatively low electric-conductivity can be used as either only the first end of the inner conductor 10 or in other parts also. This also enables the first end 11 of the first inner conductor member 10*a* to be easily heated upon electrical power being applied across the inner conductor 10 and the outer conductor 20.

The inner conductor 10 can also be composed of a material that easily absorbs high-frequency energy, or an alloy containing a material that easily absorbs high-frequency energy. This enables the first end 11 of the first inner conductor member 10*a* to be easily heated upon high-frequency electrical power, such as high-frequency alternating-current (AC) voltages being applied across the inner conductor 10 and the outer conductor 20. A carbon material can be used as the material of the inner conductor 10. A stainless-steel alloy can be used as the alloy of the inner conductor 10.

Referring to FIG. 3, the plasma formation space R is defined as a space surrounded by the inner periphery 31*b* of the dielectric member 30, the outer periphery 11*b* of the first inner conductor member 10*a*, and the first end 11 of the first inner conductor member 10*a*. The plasma formation space R is communicable with the combustion chamber 101A of the at least one cylinder 101. The outer edge 11*a* of the first end 11 of the first inner conductor member 10*a* is separated from the inner edge of the first end 31 of the dielectric member 31 by a distance L. That is, the plasma formation space R separates the first end of the first inner conductor member 10*a* from the first end 31 of the dielectric member 31. For example, the length of the inner conductor 10 in the plug axial directions Y is set to a value that enables the strength of an electric field generated at the first end 11 of the first inner conductor member 10*a* upon high-frequency AC power being applied across the inner conductor 10 and the outer conductor 20 to be increased. For example, the length of the inner conductor 10 in the plug axial directions Y may be set to $\lambda/4$; $\lambda$ represents the wavelength of the high-frequency AC voltages applied across the inner conductor 10 and the outer conductor 20.

Referring to FIG. 1, the power source 40 has a common signal ground 66 connected to the outer conductor 20. The power source 40 is connected to the ignition plug 2, i.e. the second end 12 of the second inner tubular member 10*b* and the tubular outer conductor 20. The power source 40 includes an oscillator unit 41, an amplifier 42, and a controller CC communicably connected to each other. The oscillator unit 41 includes an oscillator 41*a*, and a frequency changer 70. The oscillator 41*a* and the frequency changer 70 are communicably connected to each other.

The output controller 50 is communicably connected to the controller CC.

Specifically, the output controller 50 is configured to output an ignition control signal Ics to the oscillator 41*a* each time an on-off ignition signal Ig sent from an electronic control unit (ECU) 500, which controls the engine EN, is switched from an off state to an on state.

In accordance with the ignition control signal Ics, the controller CC causes the oscillator 41*a* to generate electromagnetic power signals, i.e. power pulses, having a predetermined high frequency, and the controller CC causes the frequency changer 70 to change the frequency of the electromagnetic power signals in accordance with, for example, the ignition control signal Ics.

After frequency adjustment, the controller CC causes the amplifier 42 to amplify, based on, for example, the ignition control signal Ics, a level of each of the electromagnetic power signals whose frequency has been adjusted, thus outputting the amplified electromagnetic power signals as electromagnetic wave power pulses Ps, i.e. voltage pulses Ps, to the ignition plug 2. For example, the frequency changer adjusts the frequency of the electromagnetic power signals to be within the frequency range from 2.40 to 2.50 GHz.

The electromagnetic wave power signals Ps are transferred to the second end 12 of the second inner conductor member 10*b* of the inner conductor 10 via the impedance adjuster 71 and the isolator 60.

The impedance adjuster 71 is capable of adjusting the impedance of a transfer route, which includes the ignition plug 2, through which the electromagnetic wave power signals Ps are transferred. For example, the impedance adjuster 71 is configured to adjust the capacitance and/or inductance of the transfer route to thereby adjust the impedance of the transfer route.

If the impedance of the transfer route to the ignition plug 2 is unmatched with the input impedance of the ignition plug 2, reflected power Pr is generated from the ignition plug 2 to be transferred from the ignition plug 2 to the power source 40. The isolator 60 isolates the reflected power Pr from the transfer route to bypass the reflected power Pr to the signal ground 66.

The reflected-power detector 80 is configured to detect the reflected power Pr, and output the detected reflected power Pr to the matching controller 72.

The matching controller 72 is configured to receive the detected reflected power Pr, and cause the impedance adjuster 71 to adjust the impedance of the transfer route, thus matching the impedance of the transfer route to the ignition plug 2 with the input impedance of the ignition plug 2.

The output controller 50 controls the power source 40 using the ignition control signal Ics to cause the power source 40 to apply, as the electromagnetic wave power signals Ps, the power pulses Ps to the ignition plug 2 with intervals therebetween during one ignition cycle of the engine EN.

For example, the output controller 50 causes the power source 40 to apply power pulses Ps across the inner conductor 10 and the outer conductor 20 with intervals Ti therebetween during one ignition cycle of the engine EN to thereby cause the gaseous density of the air-fuel mixture in the plasma formation region R to be equal to or higher than a predetermined threshold each time a corresponding one of the power pulses Ps is applied to the ignition plug 2.

The output controller 50 is capable of variably setting each interval Ti to a value depending on the operating conditions of the engine EN. The output controller 50 is configured to set each interval Ti to an initial value that enables the gaseous density of the air-fuel mixture in the plasma formation region R to be reliably equal to or higher than the predetermined threshold.

Specifically, applying, as the electromagnetic wave power signal Ps, a power pulse Ps to the ignition plug 2 causes electrical discharge to be generated in the plasma formation region R, and the generated electrical discharge developing in a plasma in the plasma formation region R.

For example, at least one computer 100*c*, which is comprised of a CPU 100*a* and a memory device, i.e. a storage, 100*b* including, for example, at least one of a RAM, a ROM, and a flash memory, is provided to implement the matching controller 72 and the output controller 50.

For example, the CPU 100*a* of the at least one computer 100*c* executes at least one program stored in the memory device 100*b*, thus implementing functions of the matching controller 72 and the functions of the output controller 50.

That is, the memory device 100*b* serves as a storage in which the at least one program is stored, and also serves as a working memory in which the CPU 100*a* performs various tasks corresponding to the respective functions.

At least two computers serving as the respective controllers 50 and 72 can be installed in the ignition apparatus 1.

Each of computes can include programmed hardware ICs or programmed hardware discrete circuits, such as field-programmable gate arrays (FPGA) or complex programmable logic devices (CPLD).

Let us consider two continuous power pulse applications, which will be referred to as a first power pulse Ps application and a second power pulse Ps application, to the ignition plug 2 are carried out by the output controller 50 during one ignition cycle of the engine EN.

The first power pulse Ps application to the ignition plug 2 causes a plasma P1 to be formed in the plasma formation region R, resulting in the plasma P1 issuing from the plasma formation region R into the combustion chamber 101. That is, the plasma P1 or a flame kernel P1 formed based on reaction between the plasma and the air-fuel mixture in the combustion chamber 101 appears in a cylindrical virtual space S. Extending the annular plasma formation region R in the Y1 direction from the second end of the second outer conductor member 22 enables the cylindrical virtual space S to be defined in the combustion chamber 101. Note that the cylindrical virtual space S can be defined as an extension of the plasma formation region R in the Y1 direction from the second end of the second outer conductor member 22.

While at least part of the plasma P1 or flame kernel P1 has been located in the cylindrical virtual space S based on the first power pulse Ps application (see FIG. 4A), the output controller 50 is specially configured to control the power source 40 to thereby perform the second power pulse Ps application to the ignition plug 2. This second power pulse Ps application forms a next plasma P2 or next flame kernel P2 generated based on reaction between the next plasma and the air-fuel mixture in the combustion chamber 101 such that the next plasma P2 or flame kernel P2 merges with the previous plasma P1 or flame kernel P1 (see FIG. 4B).

Figure 5:
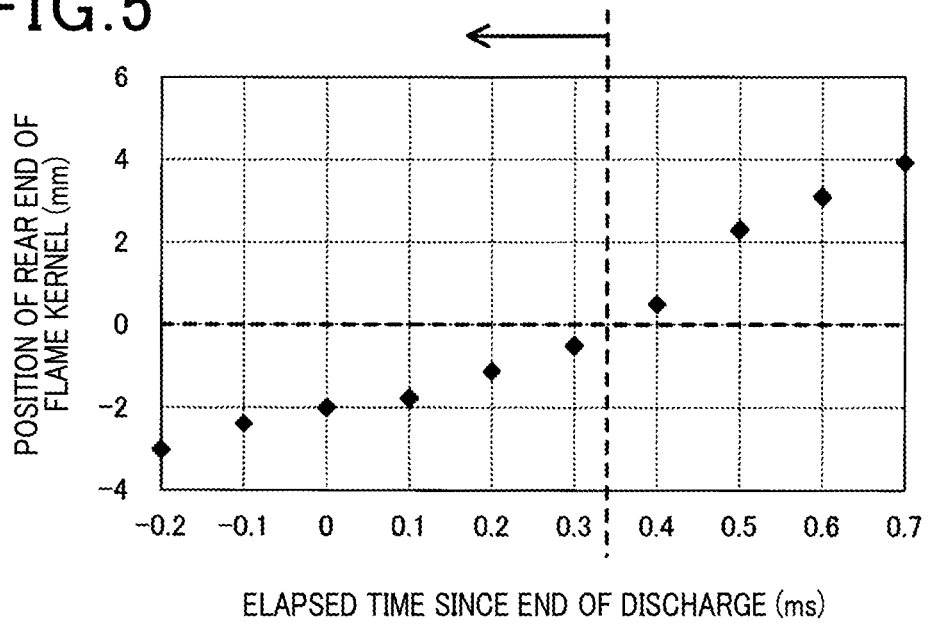
FIG. 5 is a graph schematically illustrating how a flame Kernel generated based on one power pulse application has been changed since the end of the power pulse application according to the first embodiment.

For example, FIG. 5 schematically illustrates how a flame kernel generated based on one power pulse application has been changed since the end of the power pulse application. That is, FIG. 5 schematically illustrates how a minimum distance D between a rear end of the flame kernel and the outer periphery of the cylindrical virtual space S has been changed since the end of the power pulse application (see FIG. 4C). Note that the rear end of the flame kernel represents the position of the plasma or flame kernel that is the closest to the outer periphery of the cylindrical virtual space S.

For example, the output controller 50 is specially configured to control the power source 40 to thereby perform the second power pulse application to the ignition plug 2 until the minimum distance D between the rear end of the flame kernel P1 and the outer periphery of the cylindrical virtual space S is maintained to be equal to or lower than 0 mm, i.e. an elapsed time that has elapsed since the end of the first power pulse application is equal to or smaller than 0.35 milliseconds (ms) corresponding to the minimum distance D of 0 (mm).

Note that, if the rear end of the flame kernel P1 is located within the cylindrical virtual space S, the minimum distance D between the rear end of the flame kernel P1 and the outer periphery of the cylindrical virtual space S is expressed as a negative value in FIG. 5. Additionally, note that, in FIG. 5, the section in which the elapsed time has been a negative value represents how the minimum distance D between the rear end of the flame kernel and the outer periphery of the cylindrical virtual space S has been changed during the power pulse application until the end of the power pulse application.

Figure 4A:
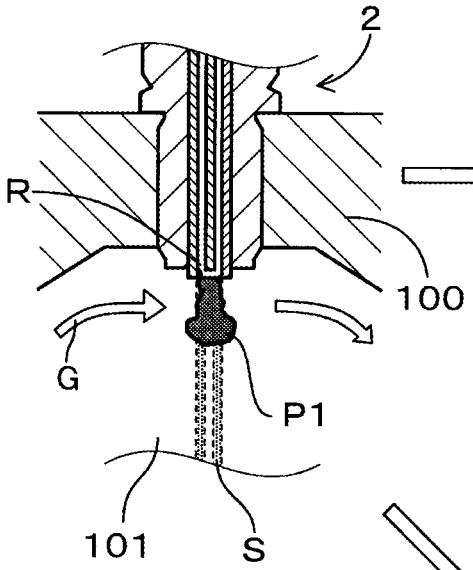
FIGS. 4A to 4C are a joint view schematically illustrating (1) A plasma or a flame kernel has been produced in a cylindrical virtual space (2) A next plasma or flame kernel that merges with the previous plasma or previous flame kernel (3) A minimum distance between a rear end of a flame kernel and the outer periphery of the cylindrical virtual space according to the first embodiment.
Figure 4B:
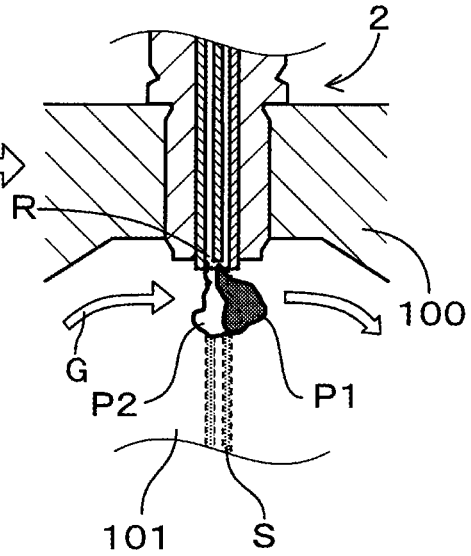
Figure 4C:
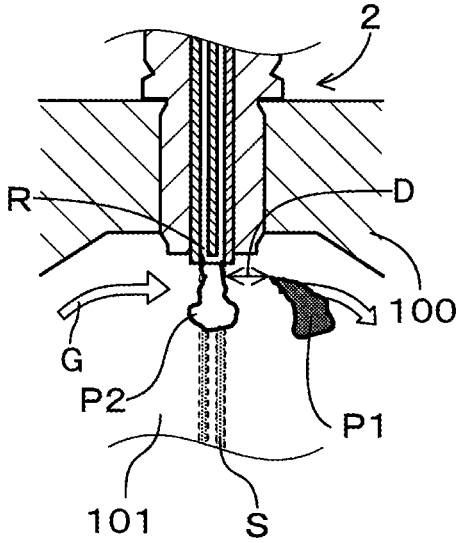

In particular, referring to FIGS. 4A and 4B set forth above, the output controller 50 controls at least one of a value w of the second power pulse Ps, a width Ta of the second power pulse Ps, and a value of the interval Ti relative to the end of the first power pulse Ps application during one ignition cycle of the engine EN.

For example, the memory device 100*b* stores a plurality of waveform patterns, i.e. pulse patterns, as pattern information PI. Each of the waveform patterns is comprised of (1) The number N of power pulses Ps applied to the ignition plug 2
(2) The level w of each power pulse Ps
(3) The width, i.e. duration, Ta of each power pulse Ps
(4) The value of the intervals Ti among the power pulses Ps The output controller 50 selects one of the pulse patterns stored in the memory device 100*b*, and outputs, to the power source 40, the ignition control signal Ics indicative of the selected pulse pattern.

Figure 6A:
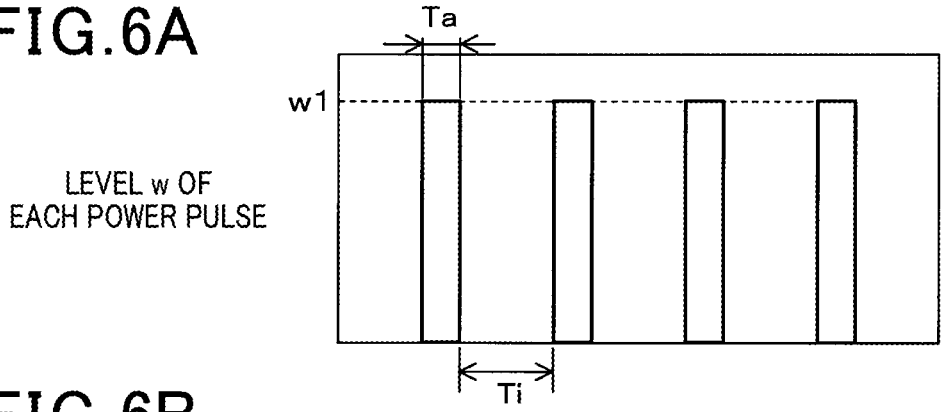
FIGS. 6A to 6C are a joint timing chart schematically illustrating a relationship between a level of each power pulse, an ignition control signal, and an ignition timing according to the first embodiment.
Figure 6B:
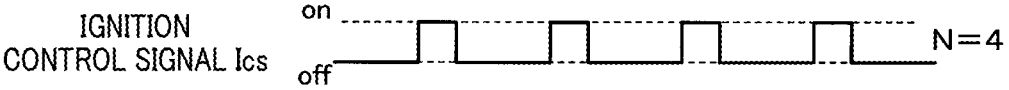
Figure 6C:
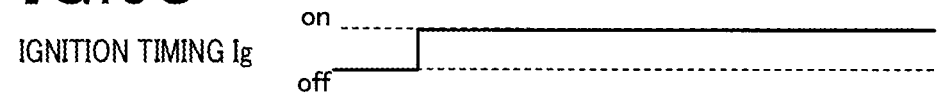

For example, as illustrated in FIGS. 6A to 6C, one of the pulse patterns selected by the output controller 50 shows (1) The number N=4 of power pulses Ps applied to the ignition plug 2
(2) The level w=w1 of each power pulse Ps
(3) A value of the width Ta of each power pulse Ps
(4) A value of the intervals Ti among the power pulses Ps The number of power pulses, the level of each power pulse, the width of each power pulse, and the intervals of the power pulses will also be referred to as pulse parameters of the power pulses hereinafter.

Note that the levels w1 of the respective power pulses Ps in the selected pulse pattern illustrated in FIG. 6A are each set to a constant value.

The flow rate detector 81 of the ignition apparatus 1 according to the first embodiment is disposed in the combustion chamber 101A, and is configured to measure the flow rate of gas in the combustion chamber 101A, and output a measurement signal indicative of the measured flow rate of gas to the output controller 50.

To the output controller 50, present values of one or more operating condition parameters indicative of the operating conditions of the engine EN, including at least one of the rotational speed of the engine EN, torque load on the engine EN, in an ignition cycle, the internal pressure of the combustion chamber 101A, and/or the temperature of the combustion chamber 101A are also input. These operating condition parameters can be measured by sensors SS illustrated in FIG. 1.

The memory device 100*b* stores map information MI indicative of the relationship for each ignition cycle among (1) Values of each operating condition parameter
(2) Values of the flow rate of gas in the combustion chamber 101A
(3) Values of the interval Ti among the power pulses Ps
(4) Values of the number N of the power pulses Ps applied to the ignition plug 2
(5) Values of the level of each power pulse Ps
(6) Values of the width of each power pulse Ps
(7) Values of the gaseous density of the air-fuel mixture in the plasma formation region R (8) Values of the minimum distance D between the rear end of a plasma or a flame kernel and the outer periphery of the cylindrical virtual space S The map information MI can be previously determined by, for example, experiments and/or computer simulations. The map information MI can also be stored in or generated by another device, and can be loaded from the device to the CPU 100*a*.

That is, the output controller 50 selects a value of the interval Ti, a value of the number N of the power pulses Ps applied to the ignition plug 2, a value of the level of each power pulse Ps, and a value of the width of each power pulse Ps; the selected values satisfy (1) The first condition that the value of the gaseous density of the air-fuel mixture in the plasma formation region R is equal to or higher than the predetermined threshold (2) The second condition that the value of the minimum distance D between the rear end of a plasma or a flame kernel and the outer periphery of the cylindrical virtual space S is equal to or less than zero Then, the output controller 50 extracts, from the waveform patterns PI, a waveform pattern satisfying the selected value of the interval Ti, the selected value of the number N of the power pulses Ps applied to the ignition plug 2, the selected value of the level of each power pulse Ps, and the selected value of the width of each power pulse Ps.

Figure 7:
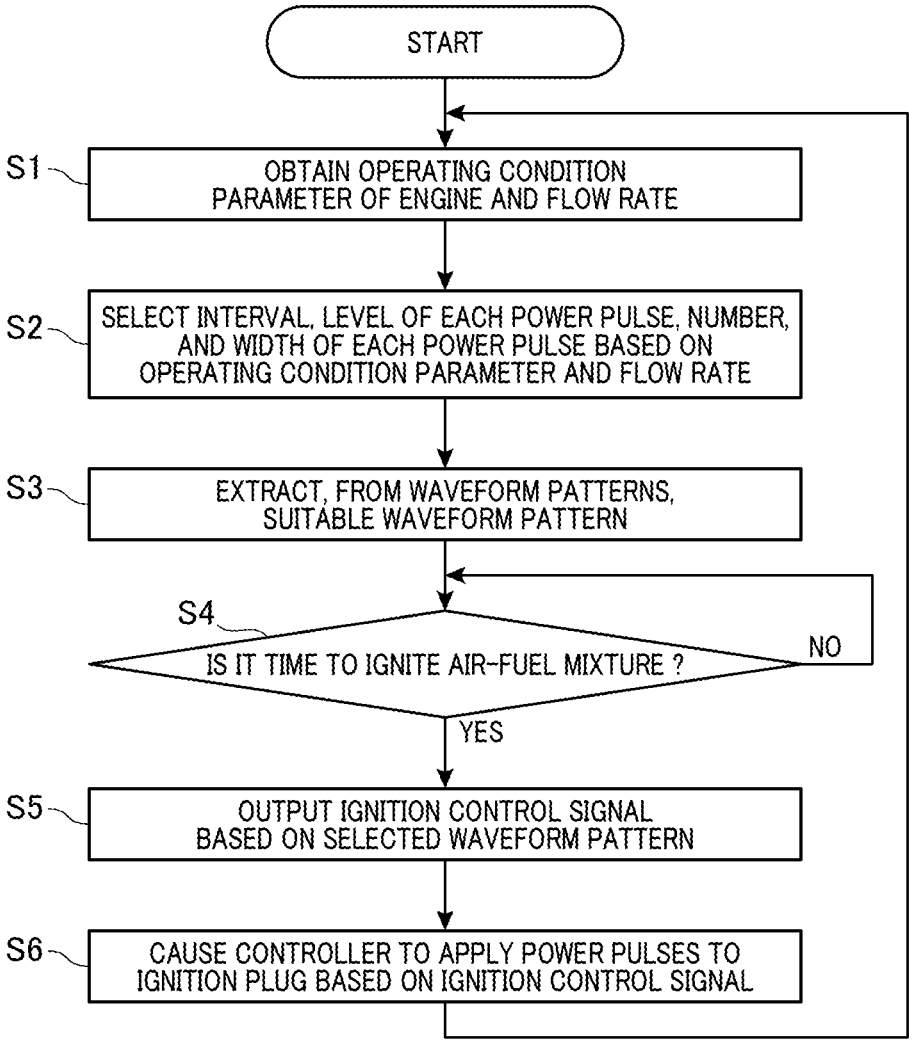
FIG. 7 is a flowchart schematically illustrating an example of an ignition control routine according to the first embodiment.

Next, the following describes how the ignition apparatus 1 operates with reference to the flowchart of FIG. 7. For example, the at least one computer 100*c*, i.e. the CPU 100*a*, executes an ignition control routine with a predetermined period. Hereinafter, one ignition control routine periodically performed by the CPU 100*a* will be referred to as a cycle.

Upon starting the current cycle of the ignition control routine, the CPU 100*a* serves as the output controller 50 to obtain the value of each operating condition parameter of the engine EN in a current ignition cycle in step S1. In step S1, the CPU 100*a* for example causes the flow rate detector 81 to measure the flow rate of gas in the compression chamber 101A, and to send the measurement signal indicative of the measured flow rate of gas thereto. If the flow rate detector 81 continuously or periodically measures the flow rate of gas in the compression chamber 101A, the CPU 100*a* simply obtains the measurement signal indicative of a currently measured flow rate of gas thereto in step S1.

Following the operation in step S1, the CPU 100*a* serves as the output controller 50 to extract, from the map information MI, a value of the interval Ti, a value of the number N of the power pulses Ps applied to the ignition plug 2, a value of the level of each power pulse Ps, and a value of the width of each power pulse Ps; the extracted values satisfy (1) The first condition that the value of the gaseous density of the air-fuel mixture in the plasma formation region R is equal to or higher than the predetermined threshold (2) The second condition that the value of the minimum distance D between the rear end of a plasma or a flame kernel, which has been formed by the previous cycle of the ignition control routine, and the outer periphery of the cylindrical virtual space S is equal to or less than zero in step S2

Note that, in step S2, the CPU 100*a* can extract, from the map information MI, a value of only one of the parameters, which include the interval Ti, the number N of the power pulses Ps applied to the ignition plug 2, the level of each power pulse Ps, and the width of each power pulse Ps, if values of the other parameters are previously determined.

Following the operation in step S2, the CPU 100*a* serves as the output controller 50 to extract, from the waveform patterns PI, a suitable waveform pattern satisfying the selected value of the interval Ti, the selected value of the number N of the power pulses Ps applied to the ignition plug 2, the selected value of the level of each power pulse Ps, and the selected value of the width of each power pulse Ps in step S3.

Then, the CPU 100*a* determines whether it is time to ignite the air-fuel mixture in the compression chamber 101A of the at least one cylinder 101 in accordance with the ignition signal Ig sent from the ECU 500 in step S4. Upon determining that it is not time to ignite the air-fuel mixture in the compression chamber 101A of the at least one cylinder 101 because of the off state of the ignition signal Ig (NO in step S4), the CPU 100*a* terminates the ignition control routine.

Otherwise, upon determining that it is time to ignite the air-fuel mixture in the compression chamber 101A of the at least one cylinder 101 because the ignition signal Ig is changed from the off state to the on state (YES in step S4), the CPU 100*a* serves as the output controller 50 to output, to the power source 40, the ignition control signal Ics based on the selected waveform pattern defined based on the selected value of the interval Ti, the selected value of the number N of the power pulses Ps applied to the ignition plug 2, the selected value of the level of each power pulse Ps, and the selected value of the width of each power pulse Ps in step S5.

In step S6, the CPU 100*a* serves as the output controller 50 to cause the controller CC to control the oscillator unit 41 and the amplifier 42 based on the ignition control signal Ics, thus outputting the power pulses Ps that satisfy the selected waveform pattern. This results in the power pulses Ps being applied across the inner conductor 10 and the outer conductor 20 of the ignition plug 2.

The following describes how the state in the combustion chamber 101A is changed based on the power pulses Ps that have the selected waveform pattern; the number N of the power pulses Ps is four.

Figure 8A:
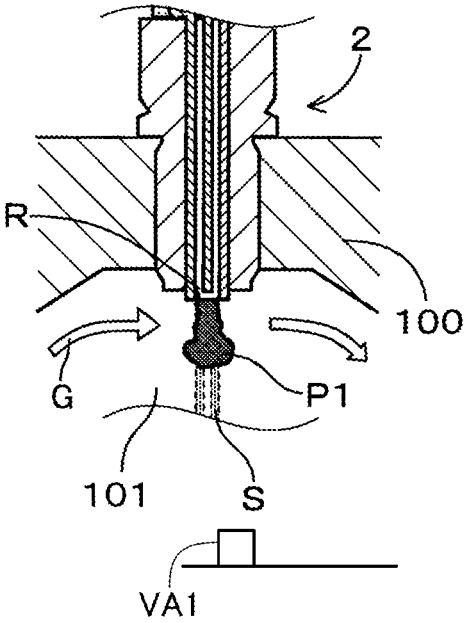
FIGS. 8A to 8D are a joint view schematically illustrating how a plasma aggregate is formed based on first and second power pulse applications according to the first embodiment.

That is, as illustrated in FIG. 8A, a first plasma P1 is formed in the plasma formation region R based on the first power pulse application VA1 based on the ignition control signal Ics. An increase in the temperature in the plasma formation region R, the formation and development of the first plasma P1 in the plasma formation region R1, and the combustion of the air-fuel mixture by the first plasma P1 increase the internal pressure of the plasma formation region R. This results in the first plasma P1 and an initial flame based on the first plasma P1 being emitted from the plasma formation region R into the combustion chamber 101A. The first plasma P1 and the initial flame based on the first plasma P1, which has entered in the combustion chamber 101A, fire a part of the air-fuel mixture, resulting in a flame kernel being formed in the combustion chamber 101A. The first embodiment will describe the collection of a plasma and a flame kernel formed based on the plasma as a "plasma aggregate".

Figure 8B:
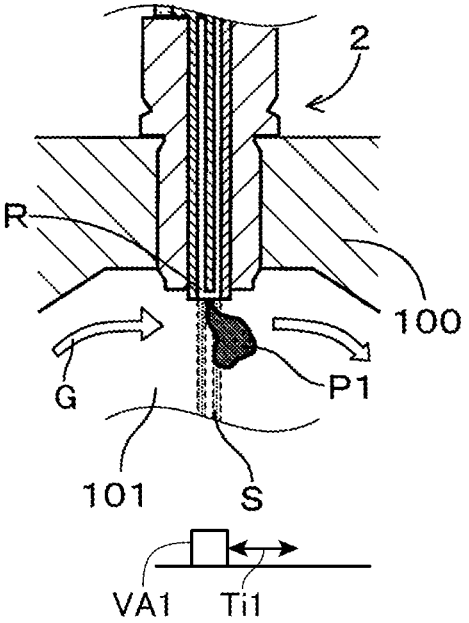
Figure 8C:
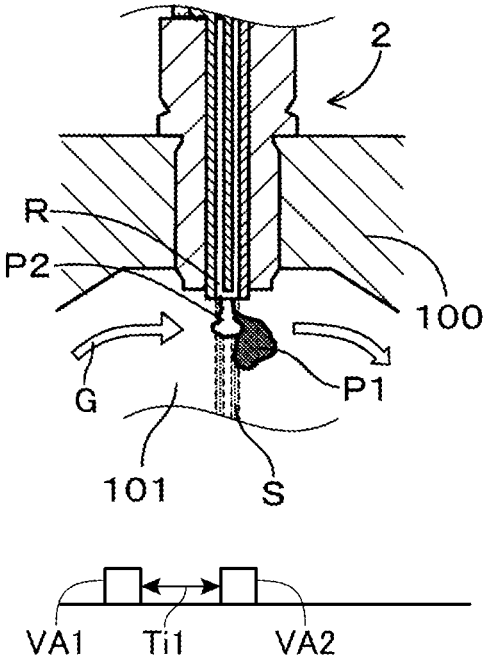
Figure 8D:
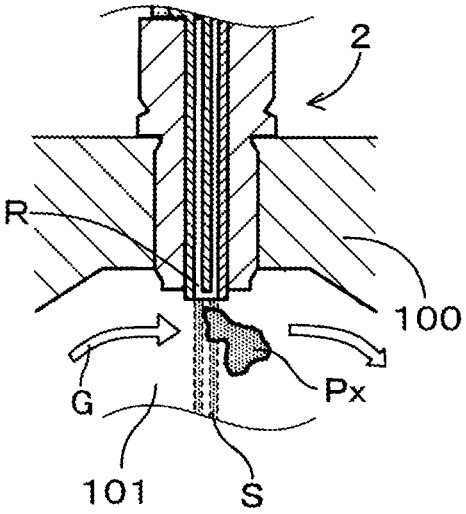

During a first interval Ti1 after the first power pulse application VA1 based on the ignition control signal Ics, the development of the first plasma P1 is interrupted, so that the air-fuel mixture located in the combustion chamber 101A flows into the plasma formation region R. As illustrated in FIG. 8B, although a current of air G causes the first plasma aggregate P1, which has entered in the combustion chamber 101A, to drift to be separated from the cylindrical virtual space S, the first interval Ti1 is terminated and thereafter the second power pulse application VA2 is performed while a part of the first plasma aggregate P1 remains in the cylindrical virtual space S (see step S2).

In other words, the output controller 50 waits for lapse of the first interval Ti1 to thereby enable fresh air to enter the plasma formation region R, so that the value of the gaseous density of the air-fuel mixture in the plasma formation region R becomes equal to or higher than the predetermined threshold.

Then, execution of the second power pulse application VA2 causes an increase in the temperature in the plasma formation region R, the formation and development of a second plasma P2 in the plasma formation region R1, and the combustion of the air-fuel mixture by the second plasma P2. This results in an increase of the internal pressure of the plasma formation region R, resulting in the second plasma P2 and an initial flame based on the second plasma P2 being emitted from the plasma formation region R into the combustion chamber 101A (see FIG. 8C).

The second plasma P2 and the initial flame based on the second plasma P2 merge, i.e. combine, with the first plasma P1 while pushing the first plasma aggregate P1 toward the inside of the combustion chamber 101A. This produces expansion growth of the combined plasma, resulting in a larger plasma aggregate Px being formed (see FIG. 8D).

When a second interval has elapsed since the termination of the second power pulse application VA2, the third power pulse application is performed in the same manner as the second power pulse application VA2. This results in a third plasma and an initial flame based on the third plasma merge, i.e. combine, with the plasma aggregate Px while pushing the plasma aggregate Px toward the inside of the combustion chamber 101A. This yields further expansion growth of the combined plasma aggregate Px.

Similarly, when a third interval has elapsed since the termination of the third power pulse application, the fourth power pulse application is performed in the same manner as the second power pulse application VA2. This results in a fourth plasma and an initial flame based on the fourth plasma merge, i.e. combine, with the plasma aggregate Px while pushing the plasma aggregate Px toward the inside of the combustion chamber 101A. This yields still further expansion growth of the combined plasma aggregate Px.

Each of the second to fourth power pulse applications forms a corresponding plasma and an initial flame based on the plasma, resulting in the plasma and the initial flame combining with the previous plasma aggregation Px while pushing the previous plasma aggregation Px toward the inside of the combustion chamber 101A even if a current of air G causes the previous plasma aggregation Px to drift. This makes it possible to reliably develop the plasma aggregation Px while locating the plasma aggregation Px deep inside the combustion chamber 101A, resulting in the ignitability of the air-fuel mixture in the combustion chamber 101A being more improved.

Next, the following shows the results of a first evaluation test of the ignition apparatus 1 according to the first embodiment and the results of a second evaluation test of a comparison ignition apparatus as a comparison example for the ignition apparatus 1, which were carried out. The comparison ignition apparatus is configured to continuously apply a voltage in each ignition cycle.

The first evaluation test detected a value of the ignition-limit air-fuel (A/F) ratio in the at least one cylinder 101 of the engine EN in which the ignition apparatus 1 is installed. A value of the ignition-limit A/F ratio represents a lower limit of the A/F ratio at which the air-fuel mixture can be ignited, i.e. fired.

In addition, the second evaluation test detected a value of the ignition-limit A/F ratio in the same cylinder 101 of the engine EN in which the comparison ignition apparatus is installed. In each of the first and second evaluation tests, an in-line gasoline engine is used as the engine EN, and the engine EN is driven at 2000 RPM under a medium load.

The conditions of the first evaluation test include (1) The level of each power pulse being set to 1000 watts (w)

(2) The duration Ta of each power pulse being set to 0.1 milliseconds (ms)

(3) The interval Ti being set to a value within the range from 0.1 (ms) to 0.4 (ms)

In contrast, the conditions of the second evaluation test include the level of continuous power applied to the ignition plug 2 being set to 1000 watts (w).

Figure 9:
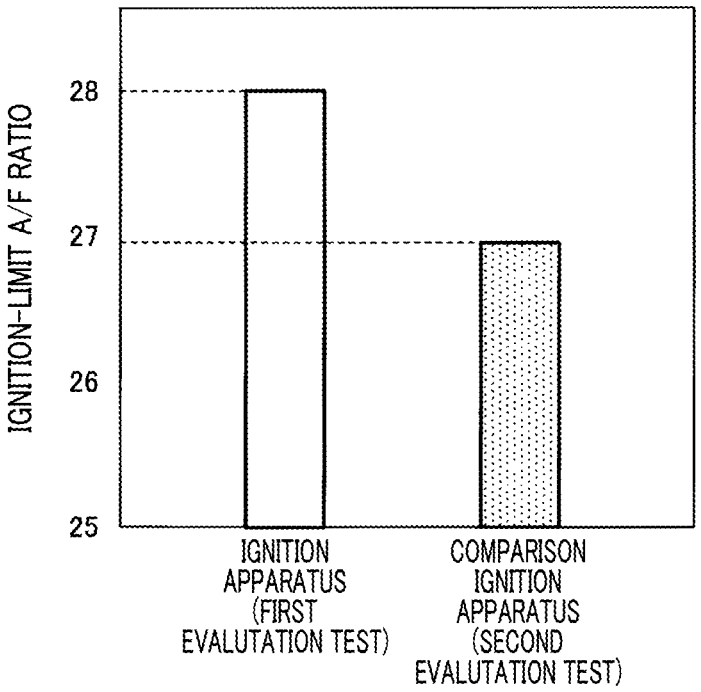
FIG. 9 is a graph schematically illustrating a value of an ignition-limit A/F ratio obtained by a first evaluation test using the ignition apparatus according to the first embodiment and a value of the ignition-limit A/F ratio obtained by a second evaluation test using a comparison ignition apparatus according to the first embodiment.
Figure 10:
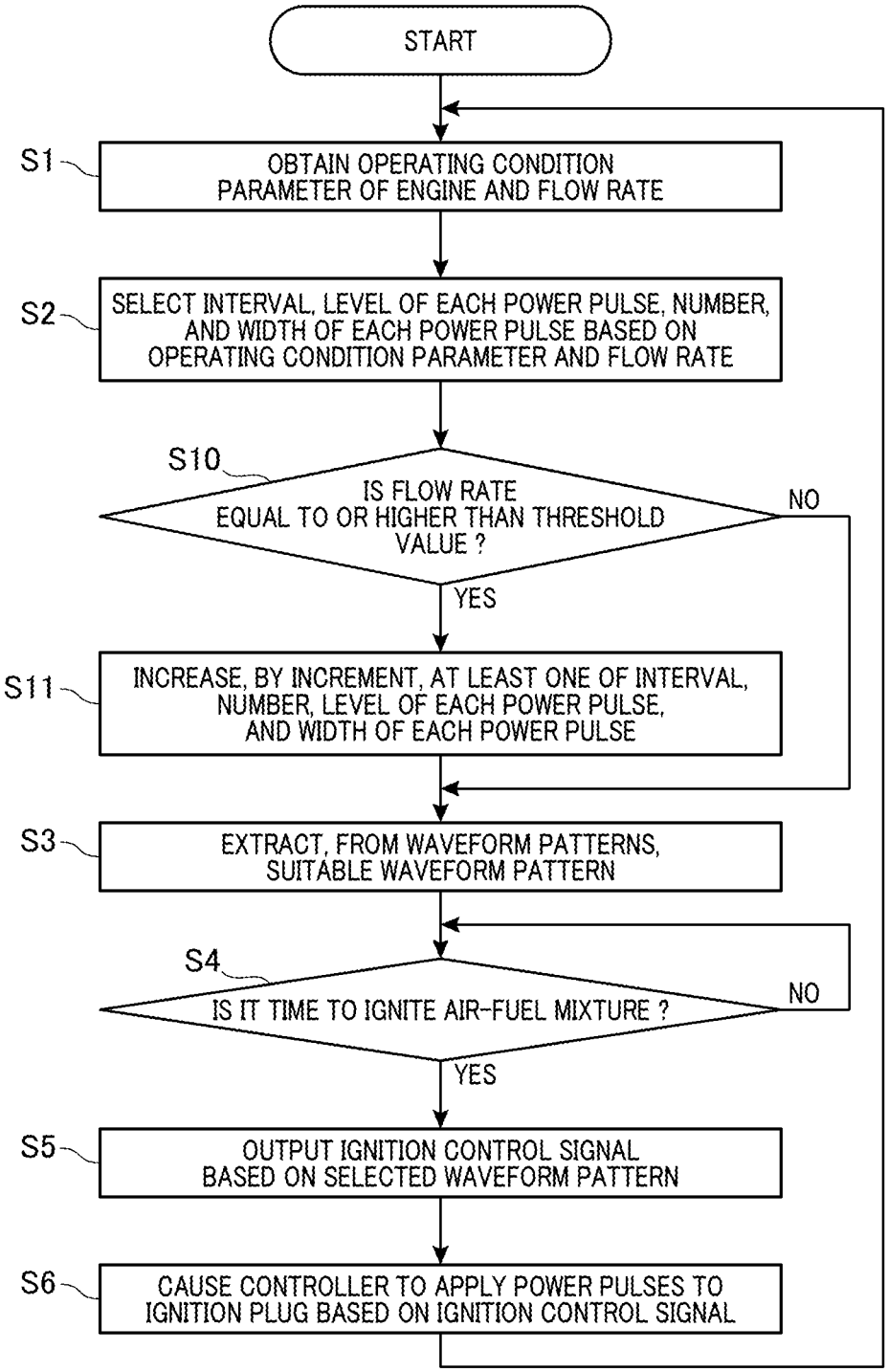
FIG. 10 is a flowchart schematically illustrating an example of an ignition control routine according to an embodiment of the present disclosure.
Figure 13:
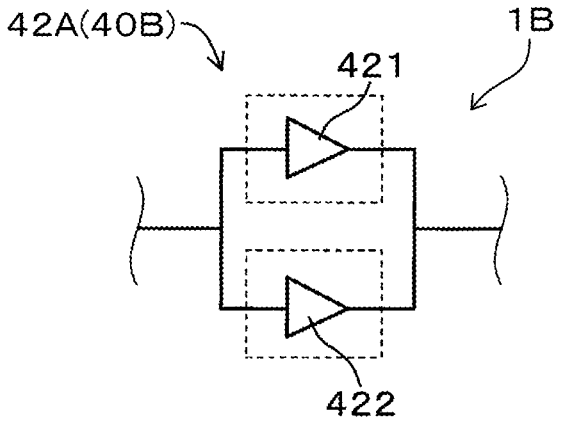
FIG. 13 is a circuit diagram schematically illustrating an example of a power source according to a second modification of the present disclosure.
Figure 14:
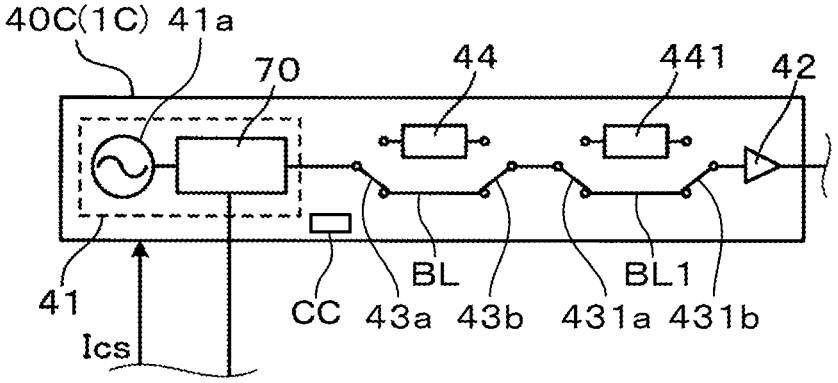
FIG. 14 is a circuit diagram schematically illustrating an example of a power source according to a third modification of the present disclosure.

FIG. 9 shows that the value of the ignition-limit A/F ratio obtained by the first evaluation test using the ignition apparatus 1 is 28.0 whereas the value of the ignition-limit A/F ratio obtained by the second evaluation test using the comparison ignition apparatus is 27. This therefore shows that the ignition-limit A/F ratio obtained from the ignition apparatus 1 is sufficiently higher than the ignition-limit A/F ratio obtained from the comparison ignition apparatus, making it possible to improve the fuel economy of the ignition apparatus 1.

Next, the following describes in details benefits obtained by the ignition apparatus 1 according to the first embodiment.

The ignition apparatus 1 is configured to form a plasma in the annular plasma formation region R defined between the inner tubular conductor 10 and the dielectric member 30. This configuration enables the plasma to fire the air-fuel mixture in the plasma formation region R, resulting in an initial flame being generated. As compared with the configuration of the conventional ignition apparatus disclosed in the published patent document, which requires both the assembly of the center and ground electrodes for generating a spark-based plasma and the electromagnetic-wave antenna for increasing and/or maintaining the volume of the formed spark-based plasma, the configuration of the ignition apparatus 1 results in (1) A smaller number of components thereof (2) A simpler structure (3) A smaller size (4) A lower manufacturing cost The ignition apparatus 1 is configured to apply power pulses with intervals therebetween to the ignition plug 2 during each ignition cycle of the engine EN. Applying each power pulse to the ignition plug 2 yields in 1. An increase in the temperature in the plasma formation region R based on formation of a plasma
2. An increase in the volume of a plasma aggregation in the plasma formation region R based on the formation and development of the plasma and the combustion of the air-fuel mixture in the plasma formation region R This increases the internal pressure of the plasma formation region R.

That is, applying each power pulse to the ignition plug 2 enables a new plasma and a new initial flame based on the new plasma to be formed in the plasma formation region R, resulting in the new plasma and the new initial flame being emitted from the plasma formation region R into the combustion chamber 101A based on the increase of the internal pressure of the plasma formation region R.

This therefore makes it possible to cause a new plasma aggregate based on the new plasma and the new initial flame to collide with a previous plasma aggregate that has stayed in the combustion chamber 101A, thus combining the new plasma aggregate with the previous plasma aggregate. This causes the plasma aggregate to further grow, thus enlarging the flame kernel while producing a larger plasma aggregate deep inside the combustion chamber 101A. This makes it possible for the plasma aggregate located deep inside the combustion chamber 101A to ignite a part of the air-fuel mixture located away from the ignition plug 2 and the inner wall of the combustion chamber 101A. This therefore prevents the plasma aggregate from being cooled by the ignition plug 2 and/or by the inner wall of the combustion chamber 101A to thereby enable smooth development of the plasma aggregate, resulting in an improvement of the ignitability of the air-fuel mixture in the combustion chamber 101A.

In particular, the output controller 50 of the ignition apparatus 1 is configured to cause the power source 40 to output power pulses with controlled pulse parameters, in particular controlled intervals Ti therebetween, in each ignition cycle to thereby enable, at the application timing of each power pulse, the gaseous density of the air-fuel mixture in the plasma formation region R to be reliably equal to or higher than the predetermined threshold.

That is, although formation of a plasma based on each power pulse applied to the ignition plug 2 consumes a part of the air-fuel mixture located in the plasma formation region R, ensuring the internal Ti between application of each power pulse and application of the next power pulse enables a part of the air-fuel mixture to flow into the plasma formation region R. This enables a sufficient amount of the air-fuel mixture, whose gaseous density is equal to or higher than the predetermined threshold, to be kept in the plasma formation region R before a next pulse-voltage application; the sufficient amount of the air-fuel mixture is needed to form a plasma in the plasma formation region R based on the next pulse-voltage application.

This enables a plasma to be reliably formed in the pulse formation region R based on the next pulse-voltage application, reliably resulting in 1. An increase in the temperature in the plasma formation region R based on the formation of the plasma
2. An increase of a plasma aggregation based on the development of the formed plasma and the combustion of the air-fuel mixture by the formed plasma This therefore reliably increases the internal pressure of the plasma formation region R, thus causing the plasma aggregate to easily flow from the plasma formation region R into the combustion chamber 101A. This results in further improvement of the ignitability of the air-fuel mixture in the combustion chamber 101A.

Additionally, the output controller 50 of the ignition apparatus 1 is configured to cause the power source 40 to apply each power pulse in each ignition cycle while a part of the plasma aggregate, which has been formed by the immediately previous pulse voltage application, remains in the cylindrical virtual space S. This enables the present plasma aggregate formed by the application of each power pulse to reliably collide with the previous plasma aggregate formed by the immediately previous pulse-voltage application to thereby reliably combine the present plasma aggregate with the previous plasma aggregate. This therefore enables the plasma aggregate that have entered in the combustion chamber 101A to be likely separated from the ignition plug 2 and the inner wall of the combustion chamber 101A, further preventing the plasma aggregate from being cooled by the ignition plug 2 and/or by the inner wall of the combustion chamber 101A.

The output controller 50 of the ignition apparatus 1 is configured to determine the pulse parameters, in particular the intervals Ti, for a present power-pulse application to thereby enable the plasma aggregate formed by the present power-pulse application to the ignition plug 2 to be reliably combined with the plasma aggregate formed by the immediately previous power-pulse application to the ignition plug 2. This configuration results in reliable development of a flame kernel in the combustion chamber 101A, resulting in further improvement of the ignitability of the air-fuel mixture in the combustion chamber 101A.

As described above, the output controller 50 can be configured to determine, for a present power-pulse application, at least one of the level w and the duration Ta of the power pulse in addition to or in place of the interval Ti. This also obtains the benefits set forth above.

The output controller 50 of the ignition apparatus 1 is configured to determine each of the pulse parameters, which include the level of each power pulse, the duration of each power pulse, and the intervals Ti between the power pulses, in accordance with the value of the flow rate of gas in the combustion chamber 101A measured by the flow rate detector 81. This configuration enables easy control of the formation state of the plasma and easy control of the rear end of the plasma, making it possible to still further improve the ignitability of the air-fuel mixture in the combustion chamber 101A.

Note that the output controller 50 of the ignition apparatus 1 can be configured to determine at least one of the pulse parameters, which include the level of each power pulse, the duration of each power pulse, and the intervals Ti between the power pulses, in accordance with the value of the flow rate of gas in the combustion chamber 101A measured by the flow rate detector 81. This configuration also enables easy control of the formation state of the plasma and easy control of the rear end of the plasma, making it possible to still further improve the ignitability of the air-fuel mixture in the combustion chamber 101A.

The output controller 50 according to the first embodiment is configured to extract, from the map information MI, a value of the interval Ti, a value of the number N of the power pulses Ps applied to the ignition plug 2, a value of the level of each power pulse Ps, and a value of the width of each power pulse Ps; the extracted values satisfy (1) The first condition that the value of the gaseous density of the air-fuel mixture in the plasma formation region R is equal to or higher than the predetermined threshold
(2) The second condition that the value of the minimum distance D between the rear end of a plasma or a flame kernel, which has been formed by the previous cycle of the ignition control routine, and the outer periphery of the cylindrical virtual space S is equal to or less than zero in step S2 of the current cycle of the ignition control routine Following the operation in step S2, the CPU 100*a* according to a first modification determines whether a value of the flow rate of air measured by the flow rate detector 81 is equal to or more than a predetermined threshold value in step S10.

Upon determining that the value of the flow rate of air measured by the flow rate detector 81 is less than the predetermined threshold value (NO in step S10), the CPU

100*a* executes the operations in steps S5 and S6 in the same manner as the first embodiment.

Otherwise, upon determining that the value of the flow rate of air measured by the flow rate detector 81 is equal to or more than the predetermined threshold value (YES in step S10), the CPU 100*a* increases, by a predetermined increment, at least one of the value of the interval Ti, the value of the number N of the power pulses Ps applied to the ignition plug 2, the value of the level of each power pulse Ps, and the value of the width of each power pulse Ps, which have been determined in step S2, in step S11.

In step S11, the CPU 100*a* can increase, by a predetermined increment, the value of the level of at least one of the power pulses Ps or the value of the width of at least one of the power pulses Ps, which have been determined in step S2.

Following the operation in step S11, the CPU 100*a* serves as the output controller 50 to extract, from the waveform patterns PI, a waveform pattern satisfying the present value of the interval Ti, the present value of the number N of the power pulses Ps applied to the ignition plug 2, the present value of the level of each power pulse Ps, and the present value of the width of each power pulse Ps in step S3.

Thereafter, the CPU 100*a* determines whether it is time to ignite the air-fuel mixture in the compression chamber 101A of the at least one cylinder 101 in accordance with the ignition signal Ig sent from the ECU 500 in step S4. Upon determining that it is not time to ignite the air-fuel mixture in the compression chamber 101A of the at least one cylinder 101 because of the off state of the ignition signal Ig (NO in step S4), the CPU 100*a* terminates the ignition control routine.

Otherwise, upon determining that it is time to ignite the air-fuel mixture in the compression chamber 101A of the at least one cylinder 101 because the ignition signal Ig is changed from the off state to the on state (YES in step S4), the CPU 100*a* executes the operations in steps S5 and S6 in the same manner as the first embodiment.

Note that a predetermined reference value or the value of the flow rate measured by the flow rate sensor 81 in the immediately previous cycle of the ignition control routine can be used as the predetermined threshold value.

As described above, the ignition apparatus 1 according to the first modification enables a part of the plasma formed in a present power-pulse application to be likely located in the cylindrical virtual space S even if the flow rate of gas in the combustion chamber has a relatively high value, which is faster than the predetermined threshold. This enables the plasma, which is busting into the combustion chamber 101A, to likely collide with the previous plasma aggregation that has been located in the combustion chamber 101A by the immediately previous power pulse application, resulting in the plasma, which is busting into the combustion chamber 101A, combining with the previous plasma aggregation.

This therefore results in an improvement of the ignitability of the air-fuel mixture in the combustion chamber 101A even if the flow rate of gas in the combustion chamber has a relatively high value.

To sum up, the first embodiment makes it possible to provide the ignition apparatuses 1, each of which has at least one of a simpler structure, a smaller size, a lower manufacturing cost, and a more improved ignitability of the air-fuel mixture.

Second Embodiment

The following describes the second embodiment of the present disclosure with reference to FIGS. 11 to 16. The second embodiment differs from the first embodiment in the following points. So, the following mainly describes the different points.

An ignition apparatus 1A according to the second embodiment includes a power source 40A. The power source 40A includes the oscillator unit 41, the amplifier 42, the controller CC, bypass switches 43*a* and 43*b*, a bypass line BL, and an attenuator 44 that has a predetermined attenuation rate. Each of the bypass switches 43*a* and 43*b* and the bypass line BL has opposing first and second ends.

The oscillator unit 41 is connected to the first end of the bypass switch 43*a*, and the second end of the bypass switch 43*a* is selectably connected to one of an input terminal of the attenuator 44 and the first end of the bypass line BL. The first end of the bypass switch 43*b* is selectively connected to one of an output terminal of the attenuator 44 and the second end of the bypass line BL. The second end of the bypass switch 43*b* is connected to the amplifier 42.

The controller CC is controllably connected to the oscillator unit 41, the amplifier 42, and each of the bypass switches 43*a* and 43*b*. That is, the controller CC is configured to control the bypass switch 43*a* to select one of the input terminal of the attenuator 44 and the first end of the bypass line BL in accordance with a power control signal Wcs sent from the output controller 50. Similarly, the controller CC is configured to control the bypass switch 43*b* to select one of the output terminal of the attenuator 44 and the second end of the bypass line BL in accordance with the power control signal Wcs sent from the output controller 50.

The output controller 50 according to the first embodiment is configured to control the power source 40 to set the level w of each power pulse Ps applied to the ignition plug 2 to a constant value during one ignition cycle.

In contrast, referring to FIG. 12A, the output controller 50 according to the second embodiment is configured to control the power source 40A to maximize the level w of the first power pulse Ps applied to the ignition plug 2 during one ignition cycle, and set the level w of the other power pulses Ps applied to the ignition plug 2 to a constant value during the ignition cycle.

Specifically, the output controller 50 according to the second embodiment is configured to output, to the power source 40A, (1) The ignition control signal Ics indicative of the selected pulse pattern (2) A power control signal Wcs indicative of the sequence of high and low levels, for controlling the levels w of the respective power pulses Ps For example, as illustrated in FIGS. 12A and 12B, the controller CC of the power source 40A controls the bypass switches 43*a* and 43*b* such that the second end of the bypass switch 43*a* is connected to the first end of the bypass line BL and the first end of the bypass switch 43*b* is connected to the second end of the bypass line BL upon the level of the power control signal Wcs being set to the high level. This enables the first power pulse Ps1 to bypass the attenuator 44, resulting in the level w of the first power pulse Ps1 being set to a first level w1 during one ignition cycle.

In contrast, as illustrated in FIGS. 12A and 12B, the controller CC of the power source 40A controls the bypass switches 43*a* and 43*b* such that the second end of the bypass switch 43*a* is connected to the input terminal of the attenuator 44 and the first end of the bypass switch 43*b* is connected to the output terminal of the attenuator 44 upon the level of the power control signal Wcs being set to the low level. This enables each of the other power pulses Ps2 to Ps4 being attenuated by the attenuator 44, resulting in the level w of each of the other power pulses Ps2 to Ps4 being set to a second level w2 lower than the first level w1 during the ignition cycle, resulting in the output of the power source 40A being stable.

The ignition apparatus 1A according to the second embodiment is configured to increase the level w1 of the first power pulse Ps1 applied to the ignition plug 2 to be higher than the levels w2 of the remaining second to fourth power pulses Ps2 to Ps4 during one ignition cycle. This therefore results in the level w1 of the first power pulse Ps1 applied to the ignition plug 2 being maximized during one ignition cycle.

This application of the first power pulse Ps1 whose power level is maximized to the ignition plug 2 results in the temperature in the plasma formation region R increasing up to a level TL based on this application of the first power pulse Ps1, formation of a plasma, and combustion of the air-fuel mixture. After slightly decrease of the temperature in the plasma formation region R, applying the second power pulse Ps2 to the ignition plug 2 results in the temperature in the plasma formation region R increasing again up to a similar level as the level TL again (see FIG. 12E). This enables the temperature in the plasma formation region R to increase up to the level TL required for plasma formation and the emission of a formed plasma while resulting in a reduction of energy applied to the ignition plug 2 in addition to the benefits obtained by the first embodiment.

The ignition apparatus 1A according to the second embodiment uses the attenuator 44 to thereby switch the level of each power pulse Ps between the first level w1 and the second level w2, but the present disclosure is not limited thereto.

Specifically, an ignition apparatus 1B according to the second modification includes a power source 40B. The power source 40B includes the oscillator unit 41, an amplifier 42A, and the controller CC communicably connected to each other. The amplifier 42A is comprised of a first amplifier 421 and a second amplifier 422 connected in parallel with each other.

That is, as illustrated in FIGS. 12A and 12B, the controller CC of the power source 40A activates both the first and second amplifiers 421 and 422 to combine the output of the first amplifier 421 and the output of the second amplifier 422 upon the level of the power control signal Wcs being set to the high level. This enables the level w of the first power pulse Ps1 to be set to the first level w1 during one ignition cycle.

In contrast, as illustrated in FIGS. 12A and 12B, the controller CC of the power source 40A activates one of the first and second amplifiers 421 and 422 while deactivating the other thereof upon the level of the power control signal Wcs being set to the low level. This enables the level w of each of the other power pulses Ps2 to Ps4 to be set to the second level w2 lower than the first level w1 during the ignition cycle.

This configuration of the ignition apparatus 1B according to the second modification therefore obtains benefits that are the same as the benefits obtained by the second embodiment.

Additionally, an ignition apparatus 1C according to the third modification includes a power source 40C. The power source 40C includes the oscillator unit 41, the amplifier 42, the controller CC, a first bypass assembly comprised of the bypass switches 43*a* and 43*b*, the bypass line BL, and the attenuator 44, and a second bypass assembly comprised of bypass switches 431*a* and 431*b*, a bypass line BL1, and an attenuator 441 (see FIG. 14). Each of the bypass switches 431*a* and 431*b* and the bypass line BL1 has opposing first and second ends.

The first bypass assembly and the second bypass assembly are connected in series to each other.

Specifically, the second end of the bypass switch 43*b* is connected to the first end of the bypass switch 431*a*. The second end of the bypass switch 431*a* is selectably connected to one of an input terminal of the attenuator 441 and the first end of the bypass line BL1. The first end of the bypass switch 431*b* is selectively connected to one of an output terminal of the attenuator 441 and the second end of the bypass line BL1. The second end of the bypass switch 431*b* is connected to the amplifier 42.

Each of the attenuators 44 and 441 has a predetermined attenuation rate, and the attenuation rate of the attenuator 441 is higher than the attenuation rate of the attenuator 44.

The controller CC is controllably connected to the oscillator unit 41, the amplifier 42, and each of the bypass switches 43*a*, 43*b*, 431*a*, and 431*b*.

The output controller 50 according to the third modification is configured to output, to the power source 40B, (1) A first ignition control signal IcsA indicative of the sequence of high and low levels (2) A second ignition control signal IcsB indicative of the sequence of high and low levels.

The combination of the first and second ignition control signals IcsA and IcsB constitute the selected pulse pattern.

Figure 15A:
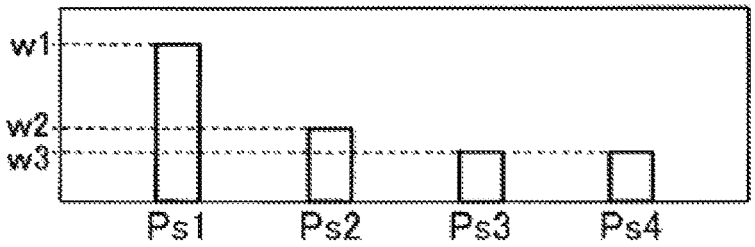
FIGS. 15A to 15D are a joint timing chart schematically illustrating a relationship between a level of each power pulse, a first ignition control signal, a second ignition control signal, and an ignition timing according to the third modification.
Figure 15B:
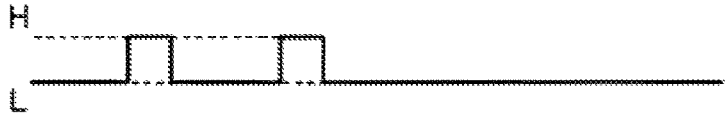

For example, as illustrated in FIGS. 15A and 15B, the controller CC of the power source 40C controls the bypass switches 43*a* and 43*b* such that the second end of the bypass switch 43*a* is connected to the first end of the bypass line BL and the first end of the bypass switch 43*b* is connected to the second end of the bypass line BL upon the level of the first ignition control signal IcsA being set to the high level.

In contrast, as illustrated in FIGS. 15A and 15B, the controller CC of the power source 40C controls the bypass switches 43*a* and 43*b* such that the second end of the bypass switch 43*a* is connected to the input terminal of the attenuator 44 and the first end of the bypass switch 43*b* is connected to the output terminal of the attenuator 44 upon the level of the first ignition control signal IcsA being set to the low level.

Figure 15C:
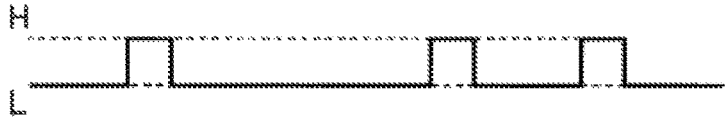
Figure 15D:
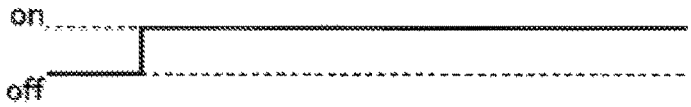
Figure 16:
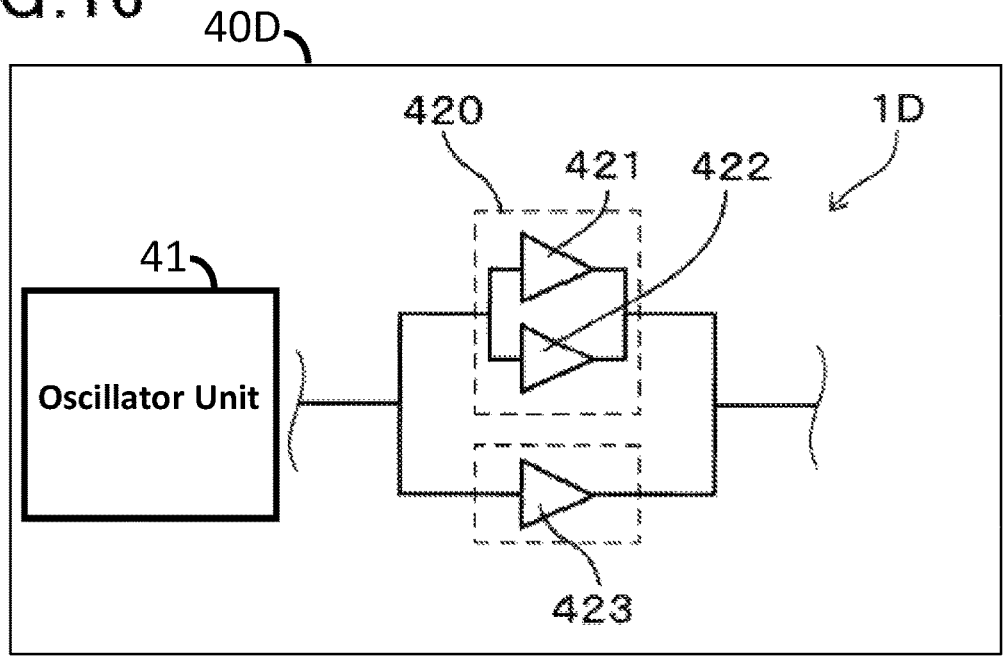
FIG. 16 is a circuit diagram schematically illustrating an example of a power source according to a fourth modification of the present disclosure.

Additionally, as illustrated in FIGS. 15A and 15C, the controller CC of the power source 40C controls the bypass switches 431*a* and 431*b* such that the second end of the bypass switch 431*a* is connected to the first end of the bypass line BL1 and the first end of the bypass switch 431*b* is connected to the second end of the bypass line BL1 upon the level of the second ignition control signal IcsB being set to the high level.

In contrast, as illustrated in FIGS. 15A and 15C, the controller CC of the power source 40C controls the bypass switches 431*a* and 431*b* such that the second end of the bypass switch 431*a* is connected to the input terminal of the attenuator 441 and the first end of the bypass switch 431*b* is connected to the output terminal of the attenuator 441 upon the level of the ignition control signal IcsB being set to the low level.

This enables the first power pulse Ps1 to bypass the attenuators 44 and 441, resulting in the level w of the first power pulse Ps1 being set to the first level w1 during one ignition cycle upon each of the first and second ignition control signals IcsA and IcsB being set to the high level.

This also enables the second power pulse Ps2 to bypass the attenuator 44 and to be attenuated by the attenuator 441, resulting in the level w of the second power pulse Ps2 being set to the second level w2, which is lower than the first level w1, during one ignition cycle upon the first ignition control signal IcsA being set to the high level and the second ignition control signal IcsB being set to the low level.

In addition, this enables each of the third and fourth power pulses Ps3 and Ps4 to be attenuated by the attenuator 44 and to bypass the attenuator 441, resulting in the level w of each of the third and fourth power pulses Ps3 and Ps4 being set to a third level w3, which is lower than the second level w2, during one ignition cycle upon the first ignition control signal IcsA being set to the low level and the second ignition control signal IcsB being set to the high level.

This enables the level w of each of the first to fourth power pulses Ps1 to Ps4 to be simply and reliably set to any one of the first to third levels w1 to w3 in the engine EN.

This configuration of the ignition apparatus 1C according to the third modification therefore obtains benefits that are the same as the benefits obtained by the second embodiment.

Additionally, an ignition apparatus 1D according to the fourth modification includes a power source 40D. The power source 40D includes the oscillator unit 41, an amplifier unit 420 comprised of the first and second amplifiers 421 and 422 connected in parallel with each other, and a third amplifier 423 connected in parallel with the amplifier unit 420 (see FIG. 16).

That is, as illustrated in FIGS. 15A and 15B, the controller CC of the power source 40D activates both the first and second amplifiers 421 and 422 to combine the output of the first amplifier 421 and the output of the second amplifier 422 upon the level of the power control signal Wcs being set to the high level.

In contrast, as illustrated in FIGS. 15A and 15B, the controller CC of the power source 40D deactivates each of the first and second amplifiers 421 and 422 upon the level of the first ignition control signal IcsA being set to the low level.

As illustrated in FIGS. 15A and 15C, the controller CC of the power source 40D activates the third amplifier 423 upon the level of the second ignition control signal IcsB being set to the high level.

In contrast, as illustrated in FIGS. 15A and 15C, the controller CC of the power source 40D deactivates the third amplifier 423 upon the level of the second ignition control signal IcsB being set to the low level.

This configuration enables the first power pulse Ps1 to be amplified by the first to third amplifiers 421 to 423 connected in parallel with each other, resulting in the level w of the first power pulse Ps1 being set to the first level w1 during one ignition cycle upon each of the first and second ignition control signals IcsA and IcsB being set to the high level.

This configuration also enables the second power pulse Ps2 to be amplified by the first and second amplifiers 421 and 422 connected in parallel with each other, resulting in the level w of the second power pulse Ps2 being set to the second level w2 during one ignition cycle upon the first ignition control signal IcsA being set to the high level and the second ignition control signal IcsB being set to the low level.

This configuration further enables each of the third and fourth power pulses Ps3 and Ps4 to be amplified by the third amplifier 423, resulting in the level w of each of the third and fourth power pulses Ps3 and Ps4 being set to the third level w3 during one ignition cycle upon the first ignition control signal IcsA being set to the low level and the second ignition control signal IcsB being set to the high level.

This enables the level w of each of the first to fourth power pulses Ps1 to Ps4 to be simply and reliably set to any one of the first to third levels w1 to w3 in the engine EN.

This configuration of the ignition apparatus 1D according to the fourth modification therefore obtains benefits that are the same as the benefits obtained by the second embodiment.

Third Embodiment

Figure 17:
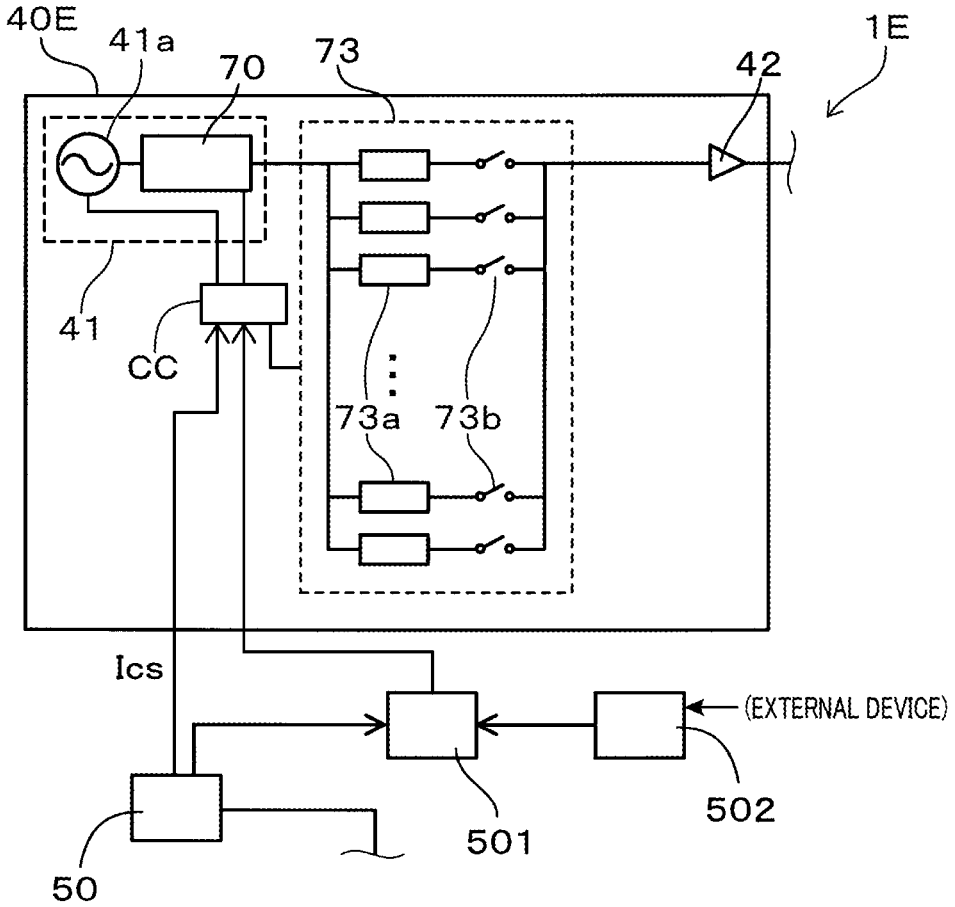
FIG. 17 is a circuit diagram schematically illustrating an example of a power source according to the third embodiment of the present disclosure.
Figure 18A:
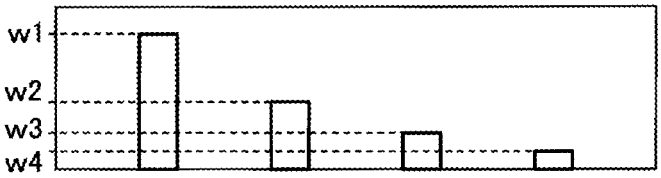
FIGS. 18A to 18D are a joint timing chart schematically illustrating a relationship between a level of each power pulse, a serial communication signal, an ignition control signal, and an ignition timing according to the third embodiment.
Figure 18B:
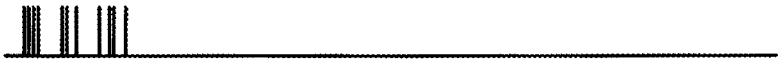
Figure 18C:
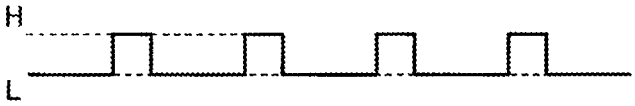
Figure 18D:
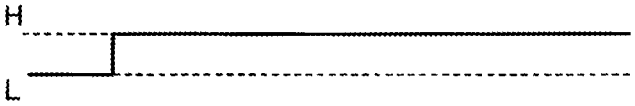

The following describes the third embodiment of the present disclosure with reference to FIGS. 17 and 18D. The third embodiment differs from the first embodiment in the following points. So, the following mainly describes the different points.

An ignition apparatus 1E according to the third embodiment includes a power source 40E. The power source 40E includes the oscillator unit 41, the amplifier 42, the controller CC, and a variable attenuator module 73. The variable attenuator module 73 is connected between the oscillator unit 41 and the amplifier 42.

The variable attenuator module 73 is comprised of a plurality of attenuators 73*a*, and a plurality of switches 73*b* connected in series to the respective attenuators 73*a*. Specifically, input terminals of the attenuators 73*a* are connected to the frequency changer 70, and output terminals of the attenuators 73*a* are connected to respective input terminals of the switches 73*b*. Output terminals of the switches 73*b* are connected to the amplifier 42. The controller CC is controllably connected to the switches 73*b*.

The ignition apparatus 1E also includes an attenuator controller 501 and a serial communication decoder 502. The attenuator controller 501 is connected to the controller CC via serial interfaces therebetween, and also connected to the serial communication decoder 502.

The serial communication decoder 502 is configured to receive serial control signals sent from, for example, external devices installed in the vehicle, and perform a decoding task of, for example, converting the serial control signals into digital data, i.e. bits each having a voltage level that can be handled by the attenuator controller 501.

The attenuator controller 501 is configured to receive the ignition control signal Ics and the serial control signals, and output, to the controller CC, serial communication signals via the serial interfaces.

Note that the timing at which the ignition control signal Ics is sent to the attenuator controller 501 from the output controller 50 is earlier than the timing at which the ignition control signal Ics is sent to the controller CC from the output controller 50.

As illustrated in FIG. 18*b*, the attenuator controller 501 is configured to (1) Generate, based on the serial control signals and the ignition control signal Ics sent from the output controller 50 before an ignition timing, the serial communication signals indicative of the levels of the respective power pulses Ps (2) Output the serial communication signals to the controller CC.

The controller CC is configured to determine, for each of the power pulses Ps, on-off patterns of the switches 73*b* to thereby determine an attenuation rate of the level of each of the power pulses Ps to be applied to the ignition plug 2 in accordance with the corresponding one of the determined on-off pattern.

For example, the determined on-off pattern of the switches 73*b* for the first power pulse represents a first level w1, and the determined on-off pattern of the switches 73*b* for the second power pulse represents a second level w2 lower than the first level w1. The determined on-off pattern of the switches 73*b* for the third power pulse represents a third level w3 lower than the second level w2, and the determined on-off pattern of the switches 73*b* for the fourth power pulse represents a fourth level w4 lower than the third level w3.

Upon it being time to ignite the air-fuel mixture in the combustion chamber 101A of the at least one cylinder 101, the output controller 50 extracts, from the map information MI, a value of the interval Ti, a value of the number N of the power pulses Ps applied to the ignition plug 2, and a value of the width of each power pulse Ps.

The extracted value of the interval Ti, the extracted value of the number N of the power pulses Ps applied to the ignition plug 2, the extracted value of the width of each power pulse Ps, and the determined level of each of the power pulses Ps satisfy (1) The first condition that the value of the gaseous density of the air-fuel mixture in the plasma formation region R is equal to or higher than the predetermined threshold (2) The second condition that the value of the minimum distance D between the rear end of a plasma or a flame kernel, which has been formed by the previous cycle of the ignition control routine, and the outer periphery of the cylindrical virtual space S is equal to or less than zero (see step S2 of the current cycle of the ignition control routine)

Then, the output controller 50 extracts, from the waveform patterns PI, a waveform pattern satisfying the selected value of the interval Ti, the selected value of the number N of the power pulses Ps applied to the ignition plug 2, and the selected value of the width of each power pulse Ps (see step S3).

The output controller 50 outputs, to the power source 40, the ignition control signal Ics based on the selected waveform pattern defined based on the selected value of the interval Ti, the selected value of the number N of the power pulses Ps applied to the ignition plug 2, and the selected value of the width of each power pulse Ps (see step S5).

Then, the output controller 50 causes the controller CC to control the oscillator unit 41 and the amplifier 42 based on the ignition control signal Ics, thus outputting the power pulses Ps that satisfy the selected waveform pattern and the determined levels of the respective power pulses Ps. This results in the power pulses Ps being applied across the inner conductor 10 and the outer conductor 20 of the ignition plug 2.

The ignition apparatus 1E according to the third embodiment is configured to successively change the levels of the power pulses Ps to be applied to the ignition plug 2 in the order from the first level w1, the second level w2, the third level w3, and the fourth level w4 while ensuring the communication quality between the power source 40E and the attenuator controller 501 using the serial interfaces therebetween (see FIG. 18A), resulting in a reduction of the number of wires between the power source 40E and the attenuator controller 501. This configuration of the ignition apparatus 1E according to the third embodiment obtains benefits that are the same as the benefits obtained by the first embodiment.

How to control each of the power sources 40 and 40A to 40E carried out by the output controller 50 is not limited to the methods described in the first to third embodiments and the first to fourth modifications. For example, the output controller 50 can be configured to control the attenuators using one of known devices, such as one or more stepping motors and/or using different voltage values.

Each of the ignition apparatuses 1 and 1A to 1E according to the above embodiments can be configured not to provide the flow rate detector 81, and can be configured to determine at least one of a value of the interval Ti, a value of the number N of the power pulses Ps applied to the ignition plug 2, a value of the level of each power pulse Ps, and a value of the width of each power pulse Ps; the selected values satisfy (1) The first condition that the value of the gaseous density of the air-fuel mixture in the plasma formation region R is equal to or higher than the predetermined threshold (2) The second condition that the value of the minimum distance D between the rear end of a plasma or a flame kernel and the outer periphery of the cylindrical virtual space S is equal to or less than zero The functions of one element in each embodiment can be distributed as plural elements, and the functions that plural elements have can be combined into one element. At least part of the structure of each embodiment can be replaced with a known structure having the same function as the at least part of the structure of the corresponding embodiment. A part of the structure of the present embodiment can be eliminated. At least part of the structure of one of the first to third embodiments can be added to or replaced with the structure of another one of the first to third embodiments.

All aspects included in the technological ideas specified by the language employed by the claims constitute embodiments of the present disclosure.

While the illustrative embodiments of the present disclosure have been described herein, the present disclosure is not limited to the embodiments described herein, but includes any and all embodiments having modifications, omissions, combinations (e.g., of aspects across various embodiments), adaptations and/or alternations as would be appreciated by those having ordinary skill in the art based on the present disclosure. The limitations in the claims are to be interpreted broadly based on the language employed in the claims and not limited to examples described in the present specification or during the prosecution of the application, which examples are to be construed as non-exclusive.

What is claimed is:

1. An ignition apparatus for igniting, based on a plasma, an air-fuel mixture in a combustion chamber of an internal combustion engine, the ignition apparatus comprising:

an ignition plug comprising:

an inner conductor;

a tubular outer conductor having an axial direction and arranged to surround the inner conductor; and a dielectric member disposed in the tubular outer conductor to form a space between the dielectric member and the inner conductor, where plasma is formed in the space formed between the dielectric member and the inner conductor so that the space defines a plasma formation region, the plasma formation region having opposing first and second ends in the axial direction of the tubular outer conductor, the first end of the plasma formation region communicating with the combustion chamber;

a power source connected between the inner conductor and the tubular outer conductor and configured to generate at least one electromagnetic power pulse;

a controller configured to cause the power source to apply electromagnetic power pulses with intervals therebetween across the inner conductor and the tubular outer conductor during an ignition cycle of the internal combustion engine, each of the electromagnetic power pulses forming at least a corresponding plasma in the plasma formation region; and the controller is further configured to:

cause the power source to apply one of the electromagnetic power pulses across the inner conductor and the tubular outer conductor as a first electromagnetic power pulse to thereby form the corresponding plasma as a first plasma or a first flame kernel based on the first plasma;

determine at least one of: (i) a level of a next one of the electromagnetic power pulses to be applied across the inner conductor and the tubular outer conductor as a second power pulse and (ii) a duration of the second power pulse; and based on the determination, form, as a second plasma, the corresponding plasma based on the second power pulse and combine the second plasma with the first plasma or the first flame kernel.

2. The ignition apparatus according to claim 1, wherein:

the controller is further configured to cause the power source to:

wait for lapse of a corresponding one of the intervals after application of the first electromagnetic power pulse to thereby result in a gaseous density of the air-fuel mixture in the plasma formation region becoming equal to or higher than a predetermined threshold before applying the second electromagnetic power pulses across the inner conductor and the tubular outer conductor as a second electromagnetic power pulse.

3. The ignition apparatus according to claim 1, wherein:

the plasma formation region includes an annular space around the inner conductor;

the controller is further configured to cause the power source to:

apply, after lapse of a corresponding one of the intervals since application of the first power pulse, the second the electromagnetic power pulses across the inner conductor and the tubular outer conductor while at least part of the first plasma or the first flame kernel is located in a virtual space, the virtual space being defined in the combustion chamber as an extension of an outer periphery of the plasma formation region in the axial direction of the tubular outer conductor from the second end of the dielectric member.

4. The ignition apparatus according to claim 1, wherein:

the controller is further configured to cause the power source such that:

a level of one of the electromagnetic power pulses applied across the inner conductor and the tubular outer conductor first during the ignition cycle as first electromagnetic power pulse is maximized among levels of all the electromagnetic power pulses applied across the inner conductor and the tubular outer conductor during the ignition cycle.

5. The ignition apparatus according to claim 1, further comprising:

a flow rate detector configured to detect a flow rate of gas in the combustion chamber, wherein:

the controller is further configured to determine, based on the measured flow rate of gas, at least one of:

(i) a level of each of the power pulses;

(ii) a value of each of the intervals (iii) a value of a duration of each of the power pulses; and (iv) the number of the power pulses.

6. The ignition apparatus according to claim 1, further comprising:

a flow rate detector configured to detect a flow rate of gas in the combustion chamber, wherein:

the controller is further configured to:

determine whether the detected flow rate is equal to or higher than a predetermined value; and perform, upon determining that the detected flow rate is equal to or higher than the predetermined threshold value, at least one of:

(i) an increase of a level of at least one of the power pulses;

(ii) a decrease of a value of at least one of the intervals (iii) an increase of the duration of at least one of the power pulses; and (iv) an increase of the number of the power pulses.

7. The ignition apparatus according to claim 1, wherein:

the plasma formation region has an annular space around the inner conductor, a virtual space being defined in the combustion chamber as an extension of the plasma formation region in the axial direction of the tubular outer conductor from the second end of the dielectric member, the ignition apparatus further comprising:

a flow rate detector configured to detect a flow rate of gas in the combustion chamber; and a storage storing information indicative of a relationship among:

values of at least one operating condition parameter indicative an operating condition of the internal combustion engine;

values of the flow rate of gas in the combustion chamber;

values of each interval between the power pulses;

values of the number of the power pulses; and values of a level of each of the power pulses;

values of a width of each of the power pulses;

values of a gaseous density of the air-fuel mixture in the plasma formation region; and values of a predetermined part of the first plasma or first flame kernel based on the plasma and an outer periphery of the virtual space, the controller being further configured to extract, from the information stored in the storage, at least one of a value of each interval between the power pulses, a value of the number of the power pulses, a value of the level of each of the power pulses, and a value of the width of each of the power pulses such that the selected values satisfy:

a first condition that the value of the gaseous density of the air-fuel mixture in the plasma formation region is equal to or higher than a predetermined threshold; and a second condition that at least the predetermined part of the first plasma or first flame kernel is located in the virtual space.

8. The ignition apparatus according to claim 7, wherein:

the predetermined part of the first plasma or first flame kernel is a rear end of the first plasma or first flame kernel, the rear end of the first plasma or first flame kernel representing a position of the first plasma or the first flame kernel that is the closest to the outer periphery of the virtual space; and the second condition is defined as a condition that the value of the minimum distance between the rear end of the first plasma or first flame kernel and the outer periphery of the cylindrical virtual space is equal to or less than zero.

9. The ignition apparatus according to claim 1, wherein an end of the dielectric member extends further in the axial direction toward the combustion chamber than an end of the inner conductor.

10. The ignition apparatus according to claim 1, wherein an end of the dielectric member extends further in the axial direction toward the combustion chamber than an end of the tubular outer conductor.

11. The ignition apparatus according to claim 1, wherein an end of the dielectric member extends further in the axial direction toward the combustion chamber than an end of the inner conductor and an end of the tubular outer conductor.

12. The ignition apparatus according to claim 1, wherein the dielectric member is coaxially disposed in the tubular outer conductor such that an outer periphery of the dielectric member contacts an inner periphery of the tubular outer conductor.

13. The ignition apparatus according to claim 1, wherein a flame kernel formed by the combination of the plasmas formed by the electromagnetic pulses ignites the air-fuel mixture in the combustion chamber.

* * * * *